US006278421B1

(12) United States Patent
Ishida et al.

(10) Patent No.: US 6,278,421 B1
(45) Date of Patent: Aug. 21, 2001

(54) METHOD AND APPARATUS FOR CONTROLLING POWER CONSUMPTION OF DISPLAY UNIT, DISPLAY SYSTEM EQUIPPED WITH THE SAME, AND STORAGE MEDIUM WITH PROGRAM STORED THEREIN FOR IMPLEMENTING THE SAME

(75) Inventors: Katsuhiro Ishida; Hiroyuki Wakayama; Hirohito Kuriyama; Akira Yamamoto; Ayahito Kojima; Masaya Tajima; Kyoji Kariya, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 08/925,072

(22) Filed: Sep. 8, 1997

(30) Foreign Application Priority Data

Nov. 6, 1996 (JP) ..... 8-294162
May 30, 1997 (JP) ..... 9-142429

(51) Int. Cl.[7] ..... G09G 3/28

(52) U.S. Cl. ..... 345/63; 345/60; 345/77; 345/147; 315/169.1; 315/169.2; 315/169.3; 315/169.4

(58) Field of Search ..... 345/63, 60, 77, 345/147; 315/169.1, 169.2, 169.3, 169.4

(56) References Cited

U.S. PATENT DOCUMENTS 3,778,673 * 12/1973 Eisenberg et al. ..... 345/63
5,329,288 * 7/1994 Kim ..... 345/63
5,343,215 * 8/1994 Tanaka ..... 345/63
5,406,305 * 4/1995 Shimomura et al. ..... 345/102
5,532,935 * 7/1996 Ninomiya et al. ..... 364/492
5,583,527 * 12/1996 Fujisaki et al. ..... 345/55
5,670,974 * 9/1997 Ohba et al. ..... 345/60
5,696,522 * 12/1997 Iwama ..... 345/60
5,745,085 * 4/1998 Tomio et al. ..... 345/63
5,757,343 * 5/1998 Nagakubo ..... 345/63
5,874,932 * 2/1999 Nagaoka et al. ..... 345/60
5,956,014 * 9/1999 Kuriyama ..... 345/146

FOREIGN PATENT DOCUMENTS 0 655 722 5/1995 (EP) .
2 260 013 3/1993 (GB) .
61-98389 5/1986 (JP) .
6-202580 7/1994 (JP) .
6-332397 12/1994 (JP) .
7-44127 2/1995 (JP) .
7-219474 8/1995 (JP) .

OTHER PUBLICATIONS

*Patent Abstracts of Japan*, vol. 13, No. 488 (P–954), Nov. 7, 1989 & JP 01–193797 A (Deikushii KK), Aug. 3, 1989.
*Patent Abstracts of Japan*, vol. 96, No. 7, Jul. 31, 1996 & JP 08–065607 A (Fujitsu General Ltd), Mar. 8, 1996.

* cited by examiner

*Primary Examiner*—William A. Cuchlinski, Jr.
*Assistant Examiner*—Marthe Y. Marc-Coleman
(74) *Attorney, Agent, or Firm*—Staas & Halsey LLP

(57) ABSTRACT

In a plasma display apparatus with power consumption control, a control method is provided that eliminates unnaturalness of images during power control and that holds power consumption to within a target value regardless of the type of image pattern displayed. Differences between power consumption $P_{SA}$ and target value $P_{SET}$ are summed to calculate power consumption sum value $P_{SUM}$, and if $P_{SUM}$ is negative, brightness set value MCBC is set to its maximum value $MCBC_{MAX}$. If $P_{SUM}$ is positive, the value calculated by the equation "$MCBC_{MAX}-P_{SUM}\times MCBC_{MAX}/P_{SUM,MAX}$" is set as the MCBC.

64 Claims, 22 Drawing Sheets

Fig.12

| $P_{SUM}$ | $a(=m_1/n_1)$ |
|---|---|
| $P_{SUM} > +P_1$ | 2/1 |
| $+P_1 \geqq P_{SUM} > +P_2$ | 1/1 |
| $+P_2 \geqq P_{SUM} > +P_3$ | 1/2 |
| $+P_3 \geqq P_{SUM} > 0$ | 1/4 |
| $0 \geqq P_{SUM} > -P_3$ | 1/8 |
| $-P_3 \geqq P_{SUM} > -P_2$ | 1/16 |
| $-P_2 \geqq P_{SUM} > -P_1$ | 1/32 |
| $-P_1 \geqq P_{SUM}$ | 1/64 |

Fig.13

| $P_{SUM}$ | $b(m_2/n_2)$ |
|---|---|
| $P_{SUM} > +P_1$ | 1/2 |
| $+P_1 \geqq P_{SUM} > +P_2$ | 1/1 |
| $+P_2 \geqq P_{SUM} > +P_3$ | 2/1 |
| $+P_3 \geqq P_{SUM} > 0$ | 4/1 |
| $0 \geqq P_{SUM} > -P_3$ | 8/1 |
| $-P_3 \geqq P_{SUM} > -P_2$ | 16/1 |
| $-P_2 \geqq P_{SUM} > -P_1$ | 32/1 |
| $-P_1 \geqq P_{SUM}$ | 64/1 |

Fig.15

| $P_{SUM}$ | VALUE TO BE SUBTRACTED FROM DATA |
|---|---|
| $P_{SUM} > +P_1$ | 64 |
| $+P_1 \geqq P_{SUM} > +P_2$ | 32 |
| $+P_2 \geqq P_{SUM} > +P_3$ | 16 |
| $+P_3 \geqq P_{SUM} > 0$ | 8 |
| $0 \geqq P_{SUM} > -P_3$ | 4 |
| $-P_3 \geqq P_{SUM} > -P_2$ | 2 |
| $-P_2 \geqq P_{SUM} > -P_1$ | 1 |
| $-P_1 \geqq P_{SUM}$ | 0 |

METHOD AND APPARATUS FOR CONTROLLING POWER CONSUMPTION OF DISPLAY UNIT, DISPLAY SYSTEM EQUIPPED WITH THE SAME, AND STORAGE MEDIUM WITH PROGRAM STORED THEREIN FOR IMPLEMENTING THE SAME

BACKGROUND OF THE INVENTION

1. Field of the Invention

The present invention relates to a method and apparatus for controlling the power consumption of a display apparatus, especially a display apparatus having a plasma display panel, and more particularly a display apparatus having an AC-driven plasma display panel, a display system equipped with such a power consumption control apparatus, and a storage medium with a program stored therein for implementing such a power consumption control method.

2. Description of the Related Art

Usually, power consumption control for a display apparatus, especially a display apparatus having an AC-driven plasma display panel (PDP), is performed by continuously monitoring the power consumption that changes as the total value of display data changes, and by forcefully reducing the brightness of the entire screen when the power consumption has exceeded its upper limit value and increasing the brightness when the power consumption drops below its lower limit value. In performing the control, in order to minimize the unnaturalness perceived by the viewer viewing the display, brightness is reduced gradually when it is necessary to reduce the brightness because power consumption is too large, and is increased quickly when the brightness can be increased because the power consumption is low enough to permit it.

In the case of an AC-driven plasma display, the control of brightness is accomplished by varying the number of sustain pulses during one frame period and thereby varying the length of the sustained-discharge period. The brightness of each pixel, based on display data, is achieved by dividing one frame into a plurality of sub-fields with varying sustained-discharge periods and by selectively enabling or disabling the sub-fields in accordance with whether the bits forming the pixel data are on or off. For example, when data of each pixel consists of eight bits, one frame is divided into eight sub-fields the ratio of whose sustained-discharge periods is $2^0:2^1:2^2: \ldots 2^7$, and the corresponding sub-fields are enabled or disabled in accordance with the bit pattern of the pixel data. In the case of color display, the above control is performed independently for each of the three kinds of pixels corresponding to R, G, and B. The brightness of the entire screen is achieved by increasing or decreasing the sustained-discharge periods of all the sub-fields while maintaining the above ratio.

As described above, in a display apparatus such as a PDP having a power consumption control function, the speed with which the brightness of the entire screen is reduced to control power consumption is set slower than the speed with which the brightness is increased, in order to minimize the unnaturalness perceived by the viewer viewing the display. In other words, power consumption is quick to rise but slow to fall; therefore, when images with rapidly varying load, such as flashing images, are successively displayed, the power consumption rises quickly in the off period, but does not fall readily in the on period because the speed with which the power consumption is lowered is slow. If such patterns are repeated, the average power consumption does not settle down to the set value but exceeds the set value. If the set value is set lower than the actually permitted power consumption value to avoid the above situation, there arises a problem when displaying images with stable load, that is, the brightness and contrast are reduced more than necessary, resulting in degradation of picture quality.

SUMMARY OF THE INVENTION

It is, accordingly, an object of the present invention to provide a method of power consumption control that can hold average power consumption within a specified value whether images with rapidly varying load continue or whether image load is stable, and can yet maintain as good a picture quality as possible.

According to the present invention, there is provided a method of controlling power consumption of a display unit, comprising the steps of: measuring the power consumption of the display unit; increasing display brightness of the display unit, or decreasing the display brightness at a speed different from the speed of increasing, in accordance with the measured value of the power consumption; summing the power consumption; and controlling the display brightness in accordance with the sum value of the power consumption and thereby controlling the power consumption to within a target value.

According to the present invention, there is also provided an apparatus for controlling power consumption of a display unit, comprising: means for inputting a measured value of the power consumption of the display unit; means for increasing display brightness of the display unit, or decreasing the display brightness at a speed different from the speed of increasing, in accordance with the measured value of the power consumption; means for summing the power consumption; and means for controlling the display brightness in accordance with the sum value of the power consumption and thereby controlling the power consumption to within a target value.

Preferably, the display unit includes a plasma display panel and a plasma display panel control circuit capable of increasing or decreasing the brightness by increasing or decreasing the number of sustain pulses applied to the plasma display panel during one frame period.

Also preferably, the above control circuit includes an input for setting the number of sustain pulses for the entire display as a display brightness value, and an input for data of each pixel defining the number of sustain pulses for each pixel, the increasing or decreasing of the brightness is achieved by increasing or decreasing the display brightness value and thereby increasing or decreasing the display brightness, and the control of the brightness is achieved by correcting the increasing or decreasing of the display brightness value in accordance with the sum value of the power consumption and thereby controlling the display brightness.

Alternatively, the control of the brightness may be achieved by determining a subtrahend based on the sum value of the power consumption, and by subtracting the subtrahend from data of all the pixels and thereby controlling the display brightness.

According to the present invention, there is also provided a method of controlling power consumption of a display unit, comprising the steps of: measuring the power consumption of the display unit; summing differences between the power consumption and its target value; determining a display brightness value for the display unit from the sum value of the power consumption; and setting the determined display brightness value in the display unit.

According to the present invention, there is also provided an apparatus for controlling power consumption of a display unit, comprising: means for inputting a measured value of the power consumption of the display unit; means for summing differences between the power consumption and its target value; means for determining a display brightness value for the display unit from the sum value of the power consumption; and means for setting the determined display brightness value in the display unit.

According to the present invention, there is also provided a display system comprising: the above-described power consumption control apparatus; a plasma display panel; a drive circuit for driving the plasma display panel; and a control apparatus for controlling the drive circuit in accordance with a set value supplied from the power consumption control apparatus.

According to the present invention, there is also provided a storage medium readable by a computer, the storage medium storing therein a program for implementing the above-described power consumption control method when connected to the computer.

BRIEF DESCRIPTION OF THE DRAWINGS

FIG. 12 is a flowchart illustrating a third example of the process for correcting the increasing/decreasing of MCBC;

FIG. 13 is a flowchart illustrating a fourth example of the process for correcting the increasing/decreasing of MCBC;

FIG. 15 is a diagram for explaining the operation of the apparatus of FIG. 14;

DESCRIPTION OF THE PREFERRED EMBODIMENTS

Figure 1:
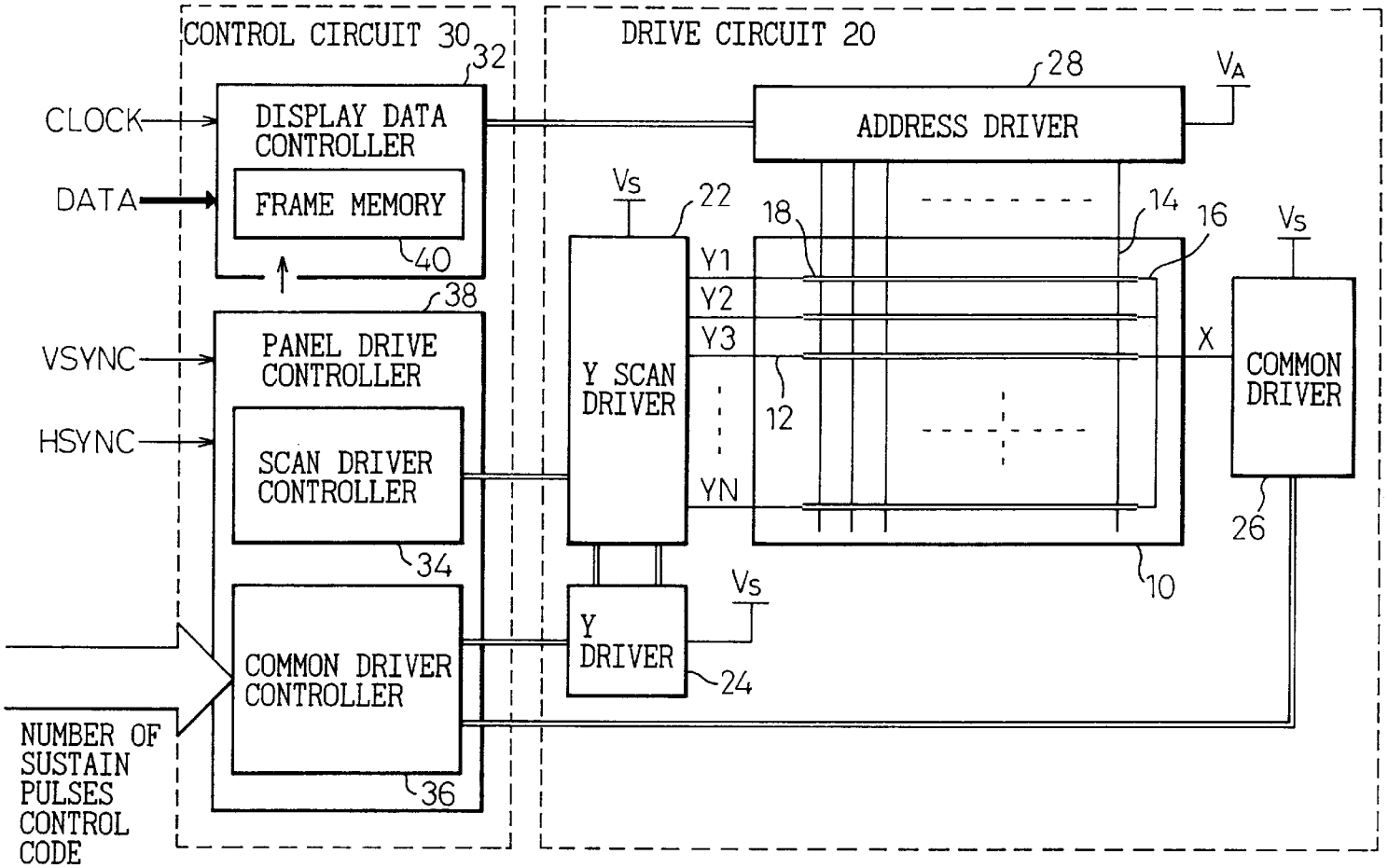
FIG. 1 is a block diagram showing the configuration of a plasma display apparatus where the present invention is applied.

FIG. 1 shows the configuration of an AC-driven plasma display apparatus as an example of a display apparatus where the present invention is applied.

A plasma display panel (PDP) 10 includes a large number of Y electrodes (scan electrodes) 12 arranged parallel to each other, a large number of address electrodes 14 arranged parallel to each other and intersecting at right angles to the Y electrodes 12, and an equal number of X electrodes (common electrodes) 16 to the number of Y electrodes and also arranged parallel to the Y electrodes. Display cells 18 are formed where each address electrode 14 intersects with the electrodes 12 and 16.

A drive circuit 20 for the PDP 10 comprises a Y scan driver 22 for driving the Y electrodes 12 independently of each other, a Y driver 24 for driving all the Y electrodes 12 simultaneously via the Y scan driver 22, a common driver 26 for driving all the X electrodes 16 simultaneously, and an address driver 28 for controlling the address electrodes 14 independently of each other. The Y scan driver 22, the Y driver 24, and the common driver 26 are supplied with a sustain supply voltage $V_S$, while the address driver 28 is supplied with an address supply voltage $V_A$.

As is well known, in the AC-driven PDP, during an address period, a write pulse is selectively applied between a Y electrode 12 and an address electrode 14 to selectively store a charge in each of the corresponding display cells, and during a sustained-discharge period following the address period, AC pulses (sustain pulses) are applied between all the Y electrodes 12 and all the X electrodes 16, and only display cells, where the charge is stored during the address period, are caused to illuminate. Accordingly, when one Y electrode 12 as a scan line is active, the pattern of the address electrodes 14 set active at that time corresponds to the on/off pattern of the display cells along that scan line, and the length of the subsequent sustained-discharge period, that is, the number of sustain pulses, corresponds to the brightness of the illuminating display cells.

A control circuit 30 for the PDP 10 includes a scan driver controller 34 for sequentially scanning the Y electrodes 12 via the scan driver 22, a display data controller 32 for supplying a display pattern on each scan line to the address electrodes 14 via the address driver 28 in synchronism with the scanning by the scan driver controller 34, and a common driver controller 36 for applying sustain pulses between the Y electrodes 12 and X electrodes 16 via the Y driver 24 and common driver 26. The scan driver controller 34 and the common driver controller 36 together constitute a panel drive controller 38. Display data (DATA) is input to the display data controller 32 in synchronism with a display clock (CLOCK), and temporarily stored in a frame memory 40. A vertical synchronizing signal ($V_{SYNC}$) and a horizontal synchronizing signal ($H_{SYNC}$) are supplied to the panel drive controller 38, while the number of sustain pulses and control codes are input to the common driver controller 36.

Figure 2:
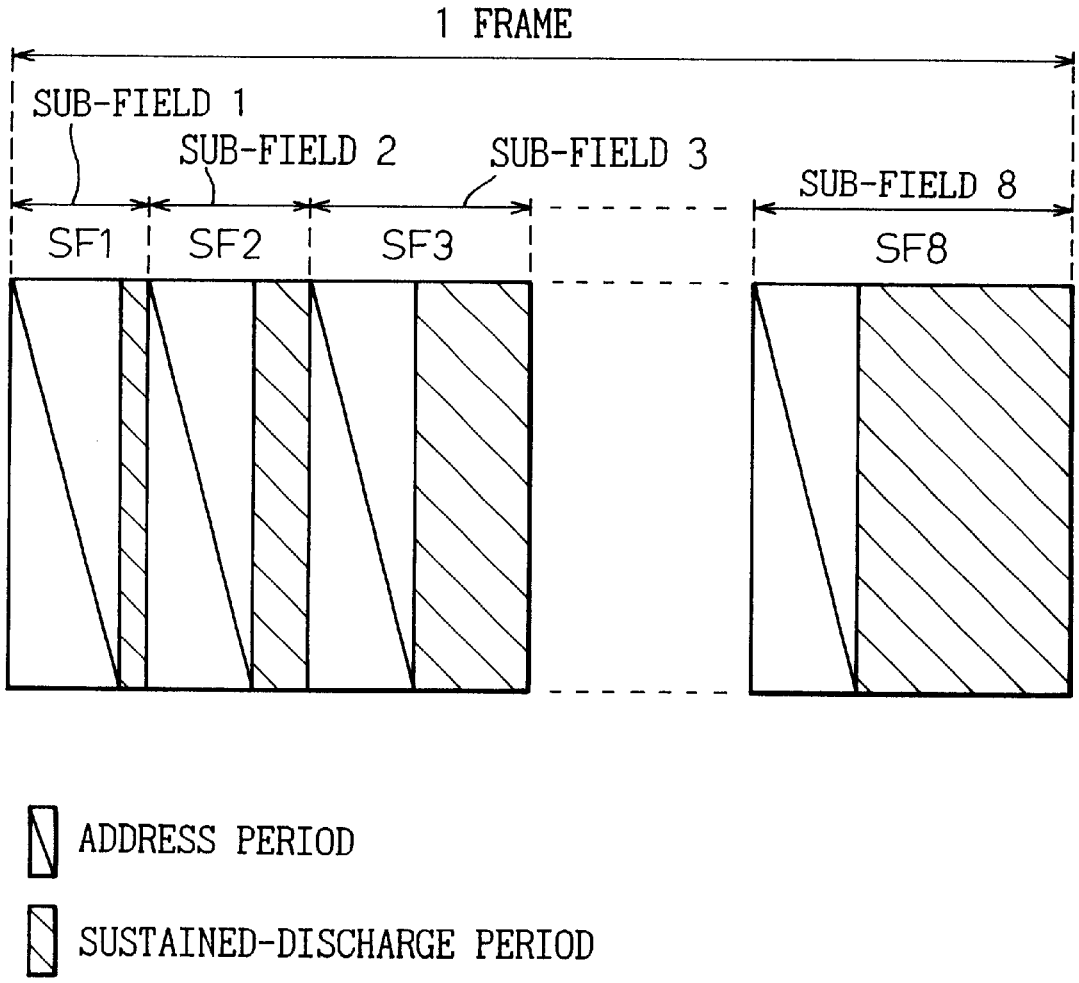
FIG. 2 is a diagram showing a sub-frame structure for achieving an intermediate gray-scale level.

FIG. 2 is a diagram for explaining a technique for achieving an intermediate gray-scale level in the AC-driven PDP. One frame (corresponding to one picture) is divided, for example, into eight sub-fields. Each sub-field includes an address period during which a charge is selectively stored or not stored in each display cell in accordance with the display data, and a sustained-discharge period during which the display cells where the charge is stored are caused to illuminate. The ratio of the sustained-discharge periods of the sub-field 1, sub-field 2, . . . , sub-field 8, that is, the ratio in terms of the number of sustain pulses, is set to $2^0:2^1 \ldots 2^7$. During the address period of the sub-field 1 the ratio of whose sustained-discharge period is $2^0$, charge is stored only on display cells for which the least significant bit 0 of 8-bit gray-scale data is 1, and during the subsequent sustained-discharge period, these display cells are caused to illuminate. Likewise, during the address period of the sub-field i+1 (i=1 to 7) the ratio of whose sustained-discharge period is $2^i$, charge is stored only on display cells for which bit i of the gray-scale data is 1, and during the subsequent sustained-discharge period, these display cells are caused to illuminate. In this way, the gray scale of each pixel can be set in 256 levels.

The brightness of the entire screen is set by increasing or decreasing the number of sustain pulses in accordance with a brightness set value (hereinafter called MCBC), while maintaining the sustain pulse count ratio of each sub-field at the above-set value. The number of sustain pulses determined for each sub-field based on MCBC is supplied to the common driver controller 36.

Figure 3:
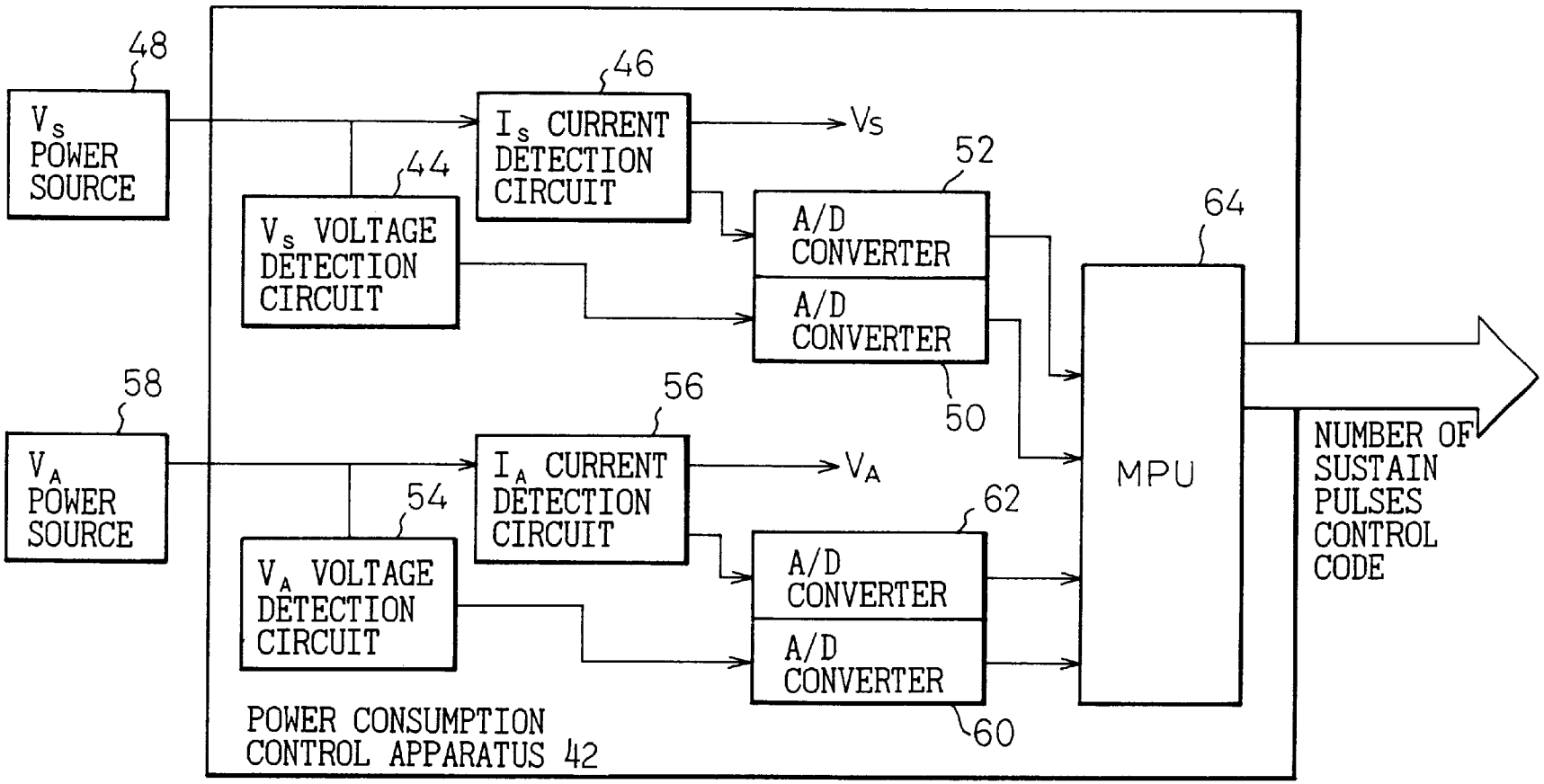
FIG. 3 is a block diagram showing the hardware configuration of a power consumption control apparatus according to a first embodiment of the present invention.

FIG. 3 is a block diagram showing the configuration of a power consumption control apparatus 42 according to a first embodiment of the present invention. A $V_s$ voltage detection circuit 44 and an $I_s$ current detection circuit 46, respectively, detect the voltage and current of the sustain power supply being supplied from a $V_s$ power source 48 to the Y scan driver 22, Y driver 24, and common driver 26 (FIG. 1). A/D converters 50 and 52, respectively, convert the voltages detected by the $V_s$ voltage detection circuit 44 and $I_s$ current detection circuit 46 into corresponding digital values. A $V_A$ voltage detection circuit 54 and an $I_A$ current detection circuit 56, respectively, detect the voltage and current of the address power supply being supplied from a $V_A$ power source 58 to the address driver 28 (FIG. 1). A/D converters 60 and 62, respectively, convert the voltages detected by the $V_A$ voltage detection circuit 54 and $I_A$ current detection circuit 56 into corresponding digital values. An MPU 64, based on the output values of the A/D converters 50, 52, 60, and 62, determines appropriate MCBC in accordance with the flow hereinafter described, converts it to the number of sustain pulses for each sub-field, and supplies the converted values to the common driver controller 36 (FIG. 1) to control the power consumption within a target value. For conversion from MCBC to the number of sustain pulses, it is desirable to use a ROM in which sustain pulse counts are stored in memory areas addressable by corresponding MCBC values.

Figure 4:
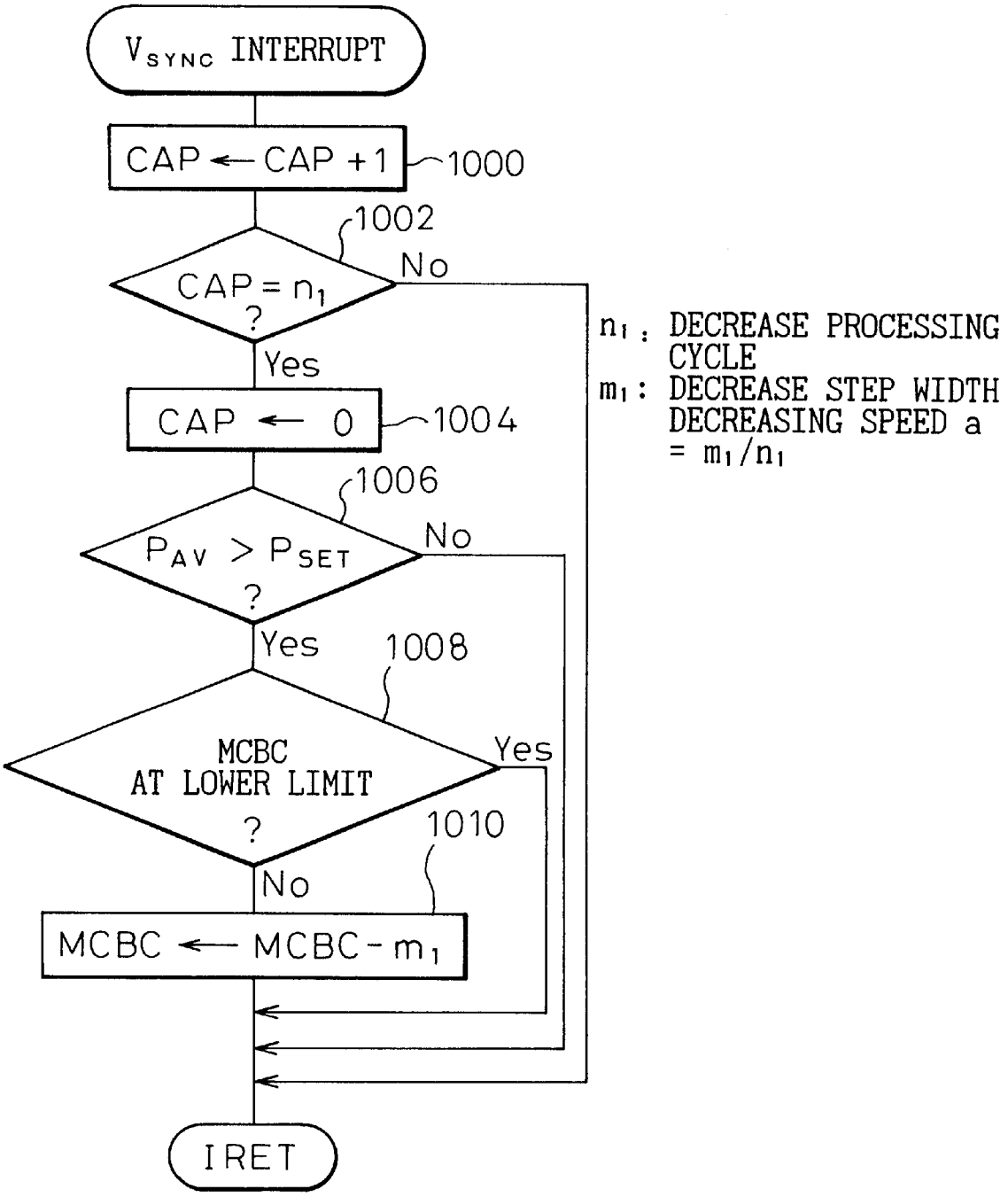
FIG. 4 is a flowchart illustrating a process for decreasing brightness.

FIG. 4 is a flowchart illustrating the processing performed by the MPU 64 to determine whether the power consumption is greater than its upper limit value and to control the power consumption within a target value by decreasing the MCBC if the power consumption is greater than the upper limit value. The processing of FIG. 4 is invoked by an interrupt that occurs in synchronism with the vertical synchronizing signal $V_{SYNC}$, that is, for every frame. First, CAP is incremented by 1 (step 1000), and it is determined whether CAP has reached a processing cycle $n_1$ (step 1002). If CAP has reached $n_1$, CAP is cleared to 0 (step 1004), and it is determined whether the average power consumption $P_{AV}$ has exceeded the upper limit value $P_{SET}$ (step 1006). The average power consumption $P_{AV}$ is obtained by calculating power consumption $P_{SA}$ from $V_S$, $I_S$, $V_A$, and $I_A$ input from the respective A/D converters 50, 52, 60, and 62, using the equation below, and by averaging the obtained values over several frame periods for reasons to be explained later.

$$P_{SA}=I_S\times V_S+I_A\times V_A$$

If $P_{AV}$ is greater than $P_{SET}$, then it is determined whether the MCBC value has reached its lower limit value (step 1008); if it has not yet reached the lower limit value, the MCBC is decreased by a decrease step width $m_1$ (step 1010).

In the above processing flow, the MCBC decreasing speed a per frame time when $P_{AV}$ is greater than $P_{SET}$ is $m_1/n_1$.

Figure 5:
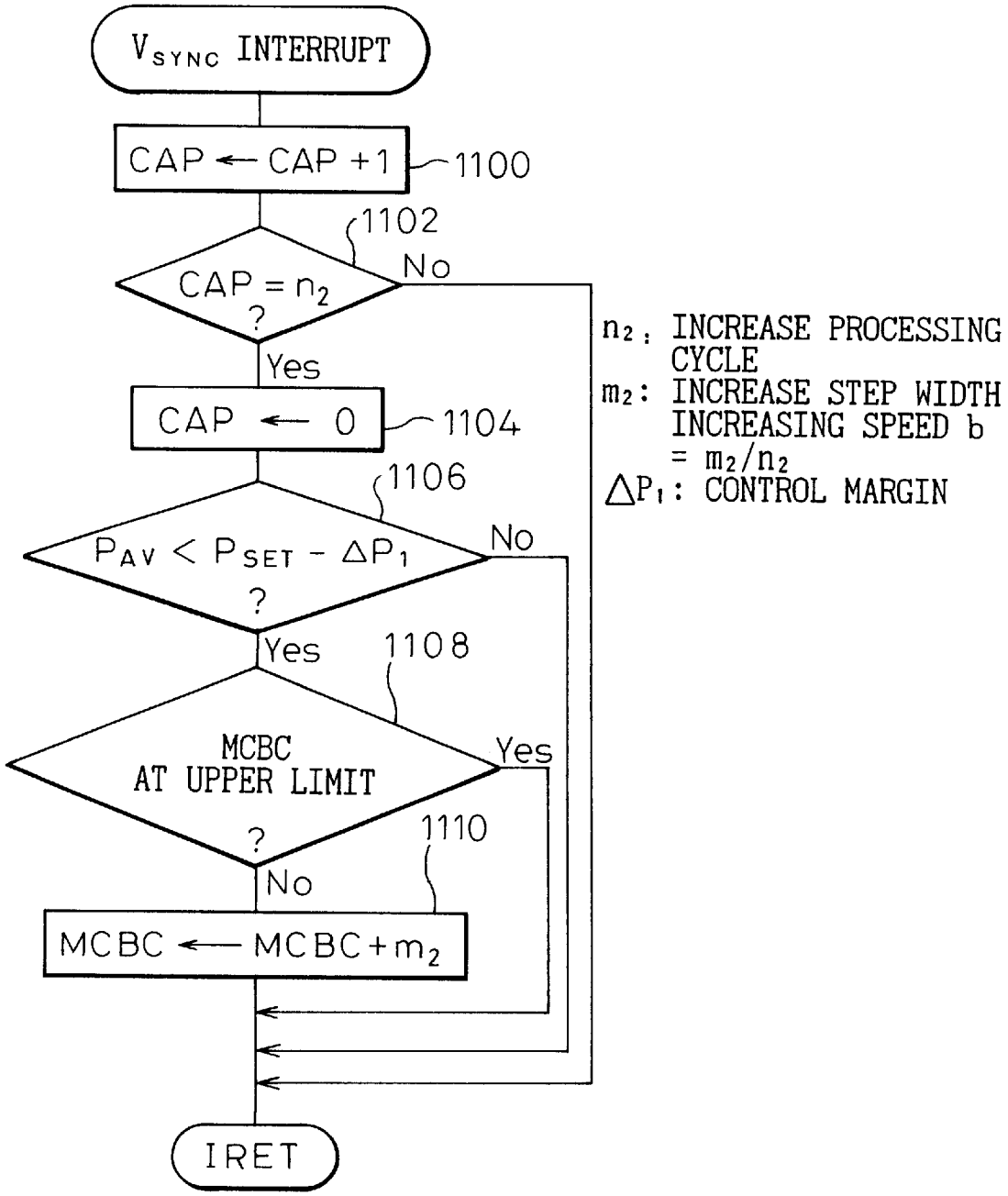
FIG. 5 is a flowchart illustrating a process for increasing brightness.

FIG. 5 is a flowchart illustrating the processing performed by the MPU 64 to determine whether the power consumption is smaller than its lower limit value and to secure the necessary screen brightness and contrast by increasing the MCBC when the power consumption is smaller than the lower limit value. The processing of FIG. 5 is also invoked by the interrupt that occurs in synchronism with the vertical synchronizing signal $V_{SYNC}$, that is, for every frame. First, CAP is incremented by 1 (step 1100), and it is determined whether CAP has reached a processing cycle $n_2$ (step 1102). If CAP has reached $n_2$, CAP is cleared to 0 (step 1104), and it is determined whether the average power consumption $P_{AV}$ has fallen below the lower limit value $P_{SET}-\Delta P_1$ (step 1106). $\Delta P_1$ is a control margin for preventing display flicker when $P_{AV}$ is close to $P_{SET}$. If $P_{AV}$ is smaller than $P_{SET}-\Delta P_1$, then it is determined whether the MCBC value has reached its upper limit value (step 1108); if it has not yet reached the upper limit value, the MCBC is increased by an increase step width $m_2$ (step 1110).

In the above processing flow, the MCBC increasing speed b per frame time when $P_{AV}$ is smaller than $P_{SET}-\Delta P_1$ is $m_2/n_2$.

Figure 6:
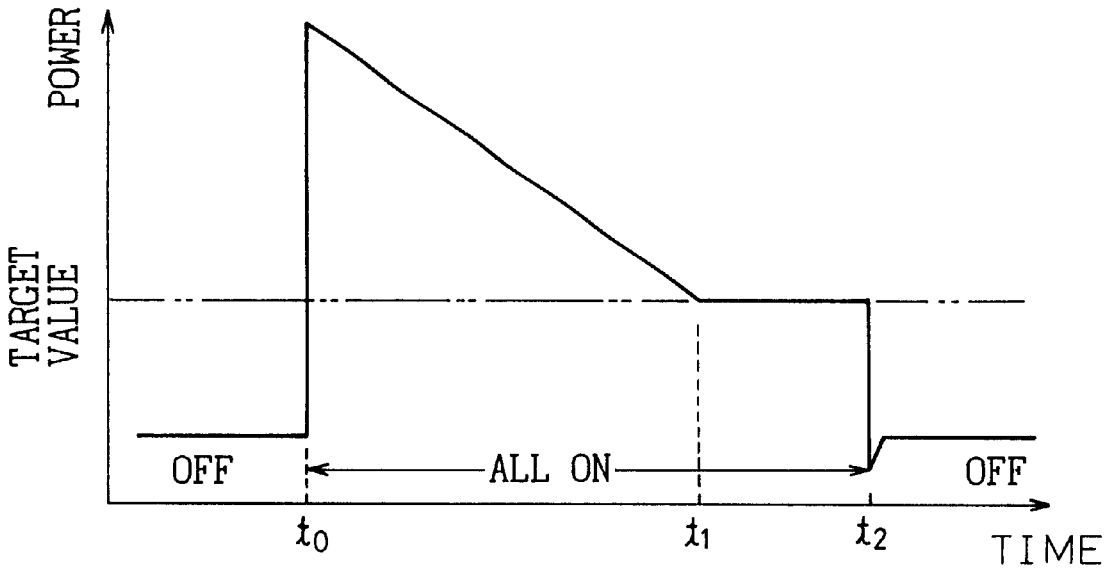
FIG. 6 is a graph for explaining the increasing/decreasing speeds of power consumption.

As previously described, basically a is set smaller than b to reduce the unnaturalness perceived by the viewer viewing the display when the power consumption control is on. FIG. 6 shows how the power consumption changes when the display changes from OFF (all pixel values are zero) to ALL ON (all pixels are at maximum values) and then to OFF again. In the OFF state up to time $t_0$, MCBC is at its maximum value. When the state changes from OFF to ALL ON at time $t_0$, the power consumption reaches its maximum value; thereafter, MCBC is gradually lowered, and the power consumption gradually decreases until reaching the target value at time $t_1$. Thereafter, when the state changes to OFF at time $t_2$, MCBC quickly rises to its maximum value, and the power consumption also quickly rises and settles at a constant value.

Figure 7:
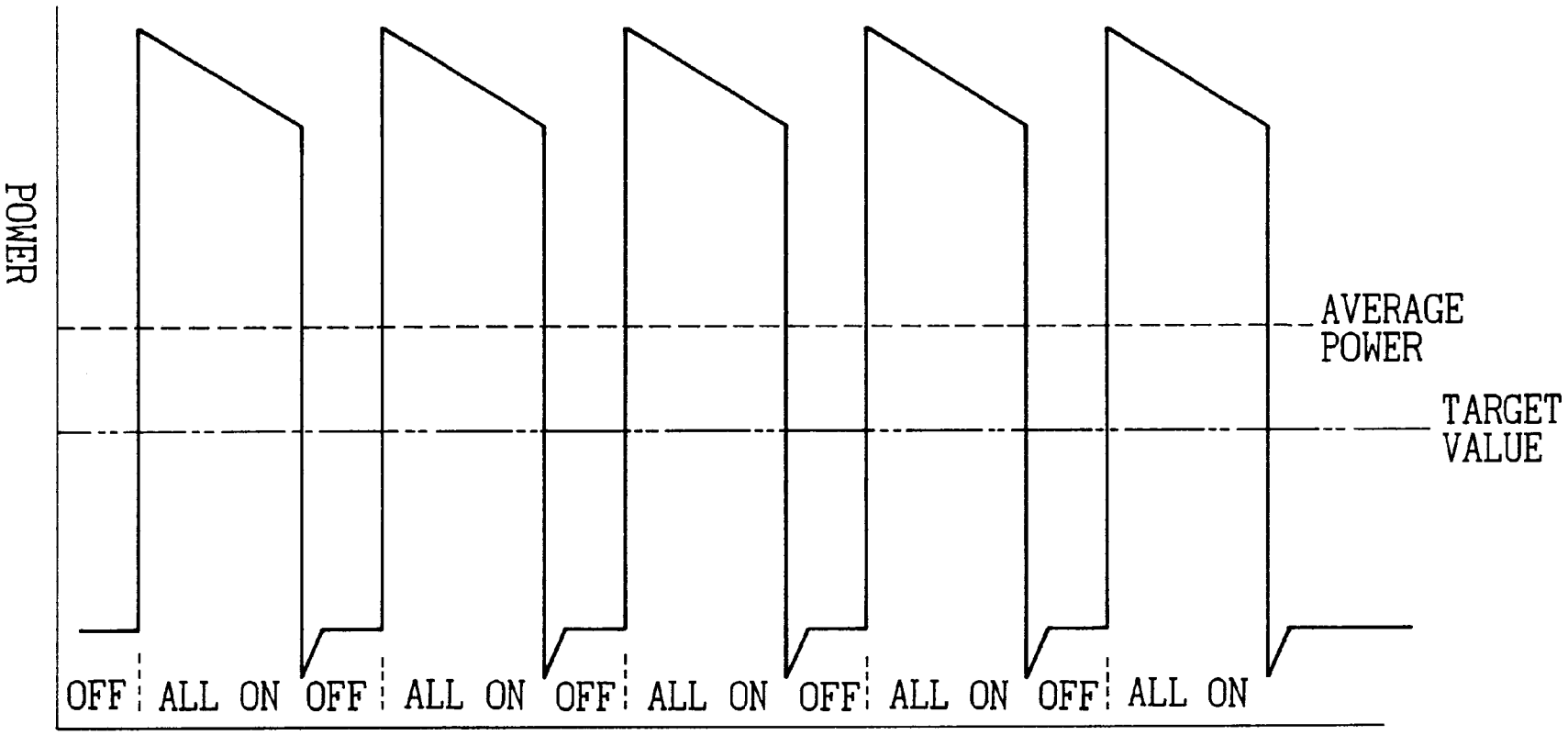
FIG. 7 is a graph for explaining the problem to be solved by the present invention.

FIG. 7 shows how the power consumption changes when the ALL ON/OFF change is repeated in a short cycle. As can be seen from FIG. 7, when the MCBC decreasing speed is set slower than the MCBC increasing speed, there arises the problem that, in the case of FIG. 7, the average power consumption settles at a level higher than the target value. To address this problem, in the first embodiment of the present invention, differences between the power consumption and its target value are summed, and, based on the sum value, correction is made to the increase/decrease of MCBC.

Figure 8:
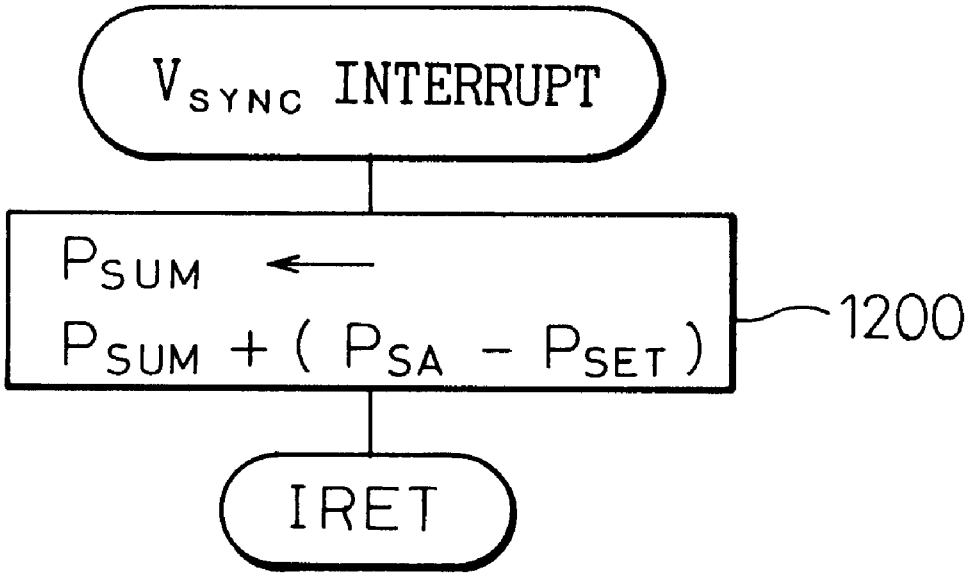
FIG. 8 is a flowchart illustrating a process for the calculation of power consumption sum value $P_{sum}$.

FIG. 8 shows a flow for the calculation of the sum, value $P_{sum}$ representing the sum of the differences between the power consumption and its target value. In FIG. 8, the processing flow is invoked by the $V_{SYNC}$ interrupt, and $(P_{SA}-P_{SET})$ is added to $P_{SUM}$ (step 1200).

Figure 9:
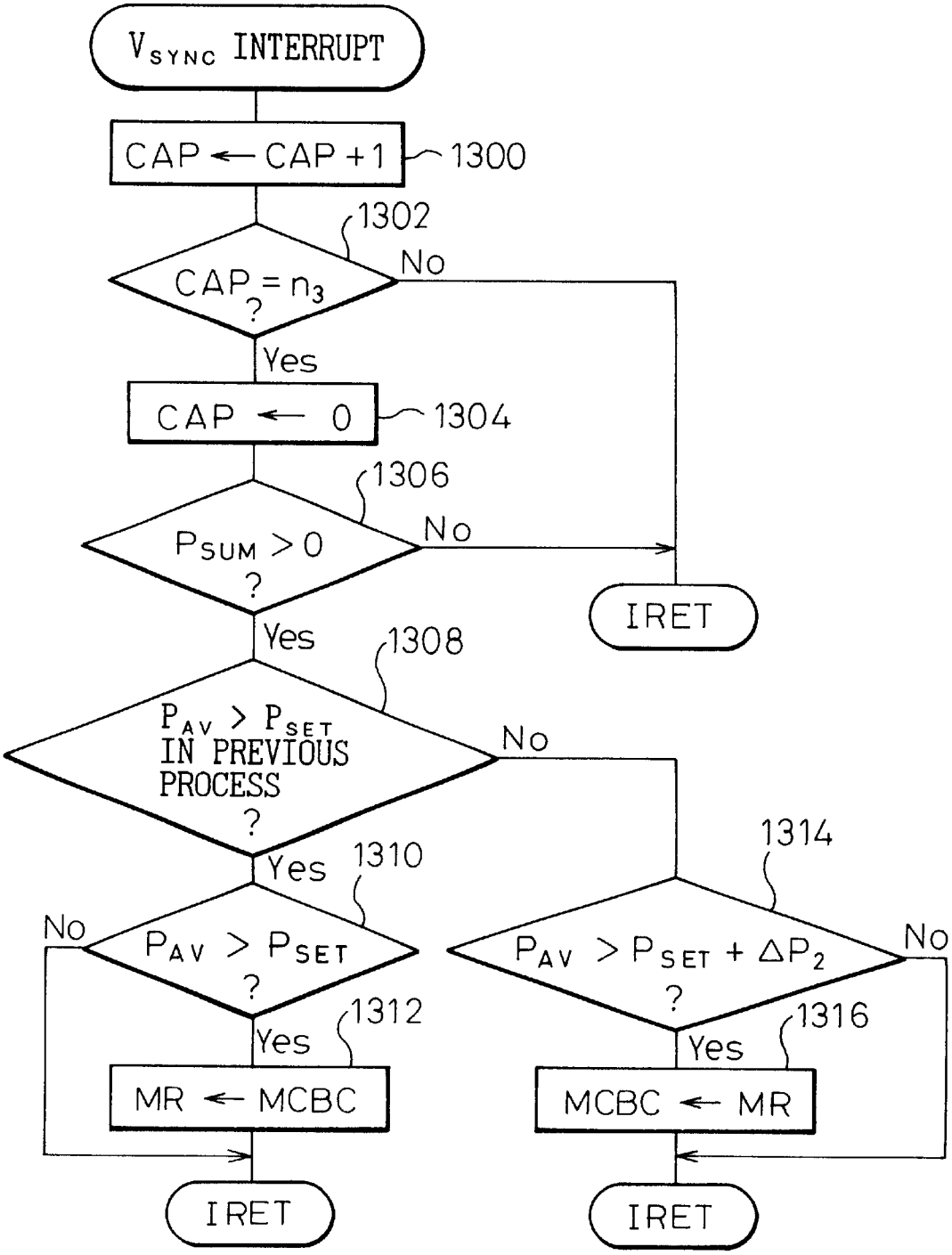
FIG. 9 is a flowchart illustrating a first example of a process for correcting the increasing/decreasing of MCBC.

FIG. 9 show a first example of MCBC increase/decrease correction based on $P_{SUM}$. Processing from step 1306 onward is repeated for every $n_3$ frame, as in the previously described processing. First, it is determined whether $P_{sum}$ is positive or not (step 1306). If $P_{sum}$ is positive, it is determined whether the average power consumption $P_{AV}$ exceeded the target value $P_{SET}$ in the previous processing (step 1308), and if $P_{AV}>P_{SET}$ in the previous processing, then it is determined whether $P_{AV}$ is greater than $P_{SET}$ in the current processing (step 1310); if $P_{AV}>P_{SET}$, the current MCBC value is stored in memory MR (step 1312). On the other hand, if, in step 1308, $P_{AV}<P_{SET}$ in the previous processing, it is determined whether $P_{AV}$ is greater than $P_{SET}+\Delta P_2$ in the current processing (step 1314). If $P_{AV}>P_{SET}+\Delta P_2$, the value stored in memory MR is taken as the MCBC value (step 1316).

That is, in the processing of FIG. 9, if $P_{sum}>0$, and if $P_{AV}$ is greater than $P_{SET}$ two times in succession, then the current MCBC value is stored in the memory. Further, if $P_{sum}>0$, and if $P_{AV}$ has increased from a level lower than $P_{SET}$ to a level substantially greater than $P_{SET}$, then the value stored in the memory is taken as the MCBC value. Here $\Delta P_2$ is a control margin for preventing display flicker.

Figure 10:
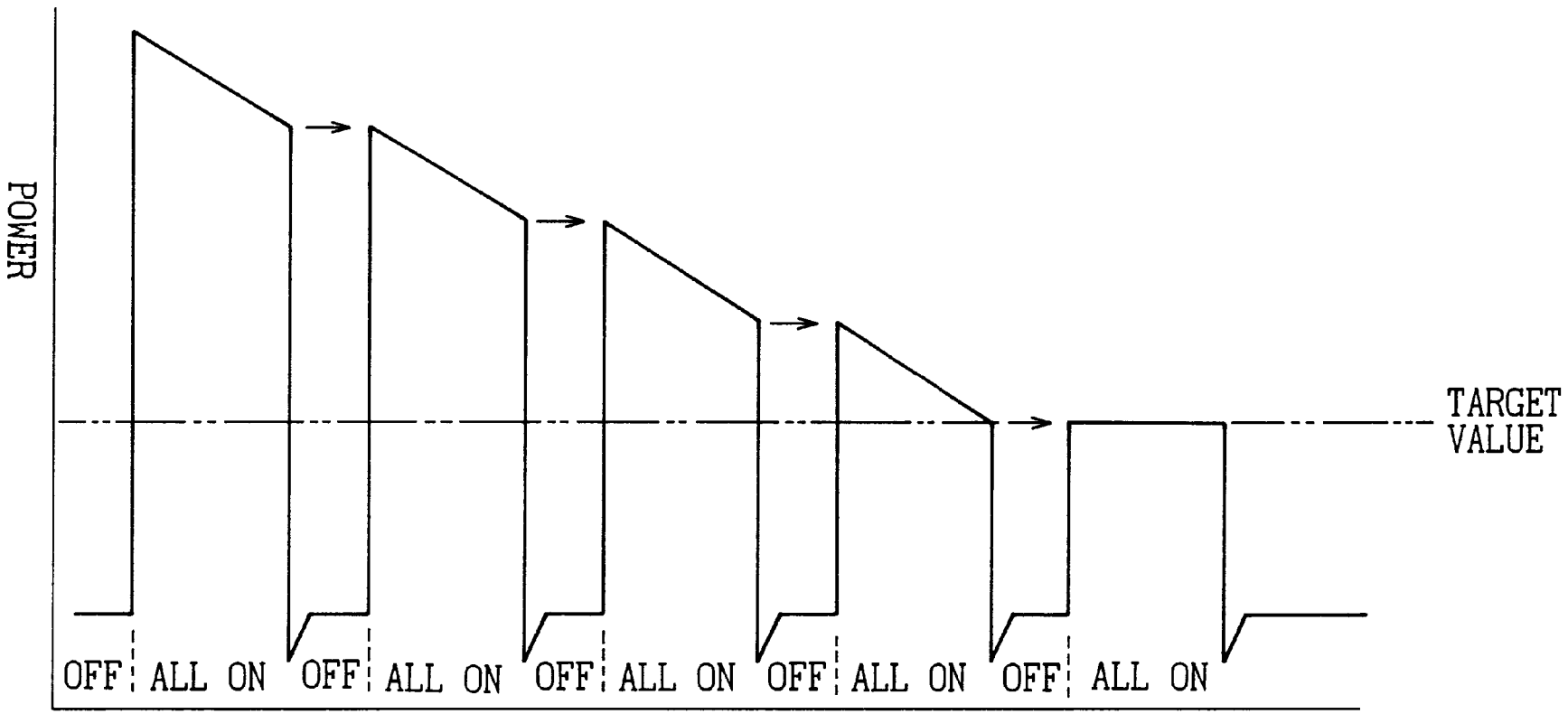
FIG. 10 is a diagram for explaining the effect achieved by the present invention.

In the first example of MCBC increase/decrease correction shown in FIG. 9, when $P_{SUM}>0$, the MCBC value when $P_{AV}>P_{SET}$, for example, during the ALL ON period, is stored in the memory, the value stored in the memory then being updated as the MCBC gradually decreases; during the next OFF period, for example, if $P_{AV}<P_{SET}$, the final value in the ALL ON period is retained in the memory, and when the state changes again to ALL ON, the final value retained in the memory is used as the MCBC value. Accordingly, even when the ALL ON/OFF change is repeated in a short cycle, control is achieved so that the power consumption during the ALL ON period gradually approaches the target value, as shown in FIG. 10. Instead of using the memory-retained value as the MCBC value, a value obtained by subtracting a constant not smaller than 1 from the memory-retained value may be used as the MCBC value.

Figure 11:
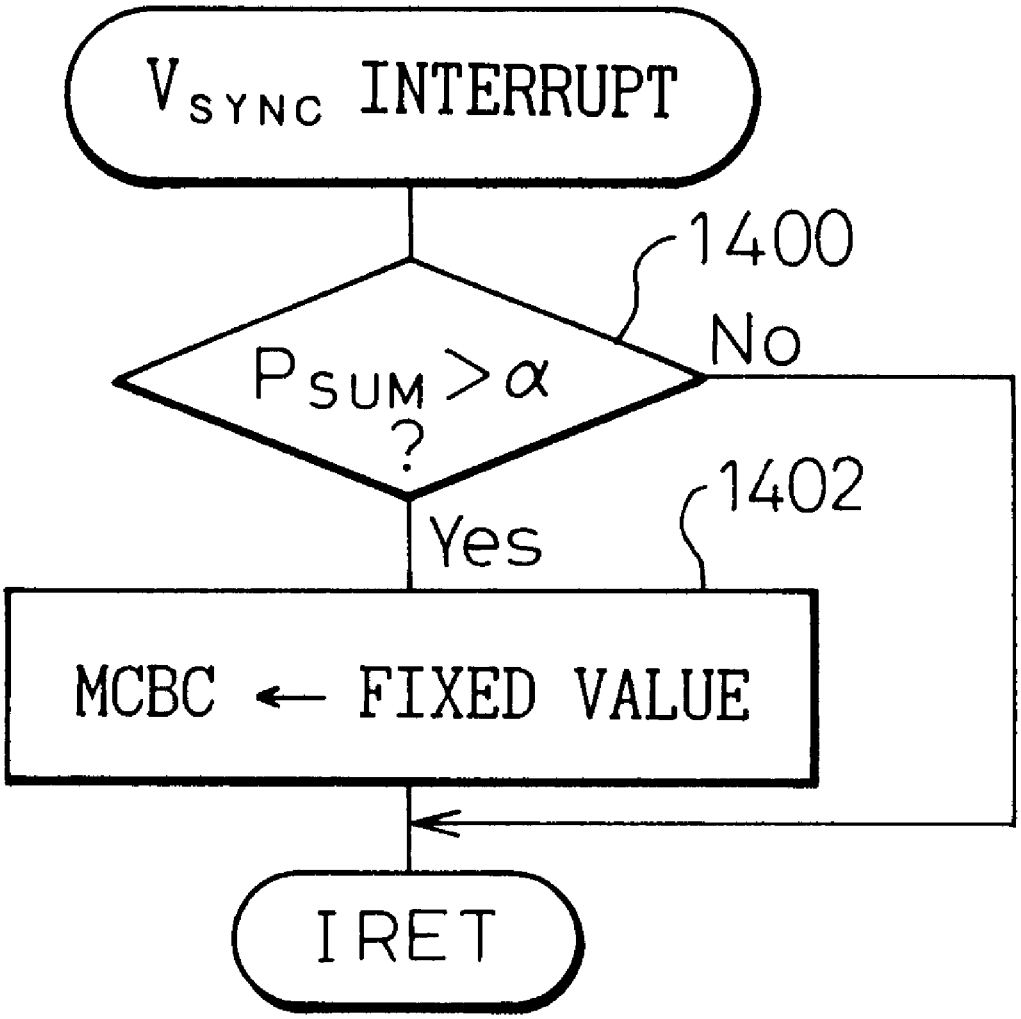
FIG. 11 is a flowchart illustrating a second example of the process for correcting the increasing/decreasing of MCBC.

FIG. 11 is a flowchart showing a second example of MCBC increase/decrease correction based on $P_{sum}$. In the flow of FIG. 11, it is determined whether $P_{sum}$ has exceeded a predetermined value $\alpha$ (step 1400), and if $P_{sum}>\alpha$, a sufficiently low fixed value is set as the MCBC (step 1402). That is, the value of $\alpha$ serves as an upper limit on the sum value $P_{sum}$ that adds up excess power values; if this upper limit is exceeded, then the value is determined to be abnormal, and the MCBC is fixed to a low value, regardless of the display brightness value, to protect the power supplies, etc. and to recover the power by an amount proportional to the excess value and thereby control the power within the set value.

Regarding the decreasing speed a $(=m_1/n_1)$ in the processing (FIG. 1) in which the MCBC is decreased when the power consumption exceeds the set value, it can be seen that the slower the decreasing speed a is, the more slowly the brightness and contrast decrease and the less the unnaturalness that the viewer viewing the display perceives, but the slow decreasing speed is disadvantageous from the viewpoint of suppressing power consumption. Conversely, as the decreasing speed a increases, the response to excessive power consumption becomes faster, but the unnaturalness increases. To address this problem, in a third example of MCBC increase/decrease correction based on $P_{sum}$ according to the present invention, the range of values of $P_{sum}$ from the positive to the negative side is divided, for example, into eight levels, and the decreasing speed is changed according to the value of $P_{sum}$ so that when the value of $P_{sum}$ is large in the positive sense, priority is given to power control and the value of a is increased, and when the value of $P_{sum}$ is large in the negative sense, priority is given to picture quality and the value of a is reduced, as shown in FIG. 12.

Next, when we look at the increasing speed b $(=m_2/n_2)$ in the processing (FIG. 5) in which the MCBC is increased when the power consumption is sufficiently low to permit it, we can see that, contrary to the case of decreasing MCBC, a higher increasing speed b and, hence, a faster change of brightness and contrast, is advantageous in reducing the unnaturalness perceived by the viewer viewing the display; therefore, when the power consumption is sufficiently low, increasing the increasing speed gives better results. Conversely, if the increasing speed b is reduced, the unnaturalness increases, but reduced increasing speed is advantageous when there is no room for increasing the power consumption. In view of this, in a fourth example of MCBC increase/decrease correction based on $P_{sum}$ according to the present invention, the range of values of $P_{sum}$ from the positive to the negative side is divided, for example, into eight levels, and the increasing speed is changed according to the value of $P_{sum}$ so that when the value of $P_{sum}$ is large in the negative sense, priority is given to picture quality and the value of b is increased, and when the value of $P_{sum}$ is large in the positive sense, priority is given to power control and the value of b is reduced, as shown in FIG. 13.

Figure 14:
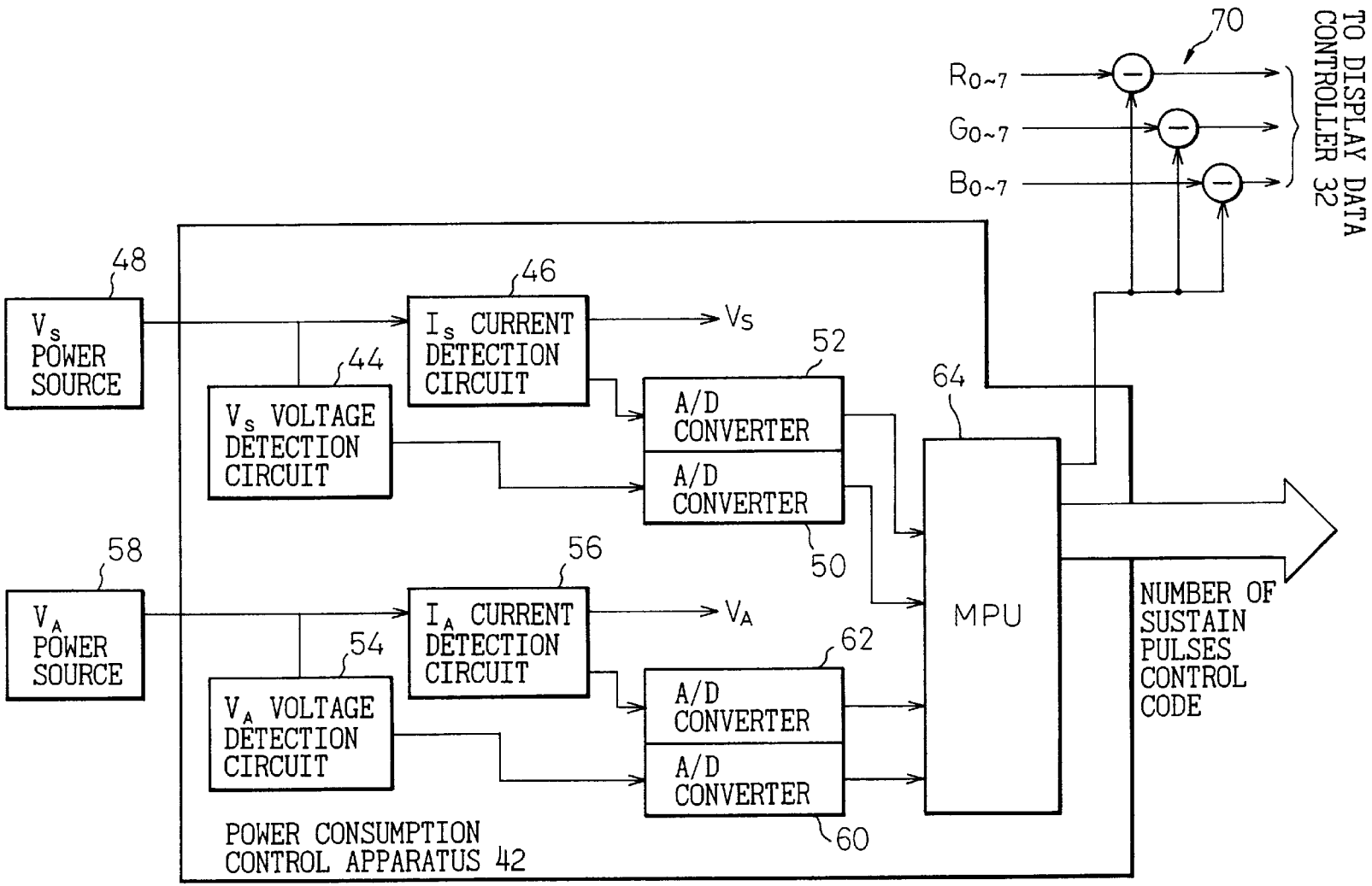
FIG. 14 is a block diagram of a power consumption control apparatus according to a second embodiment of the present invention.

FIG. 14 shows the configuration of a power consumption control apparatus 42 according to a second embodiment of the present invention. As in the first embodiment, in the second embodiment also, the MPU 64 performs control to increase or decrease the MCBC in accordance with the flows of FIGS. 4 and 5. Subtractors 70 subtract the subtrahend given by the MPU 64 from $R_0$ to $R_7$, $G_0$ to $G_7$, and $B_0$ to $B_7$ which are data to be supplied to the display data controller 32, and supplies the resulting values to the display data controller 32. The subtrahend is determined according to the value of $P_{sum}$ as shown in FIG. 15. When the subtrahend for the display data is changed, the number of sustain pulses for the entire screen changes, so that the average power consumption can be prevented from exceeding the set value.

Lastly, we will describe the purpose of using $P_{AV}$ obtained by averaging $P_{SA}$ over several frame periods rather than directly using $P_{SA}$ calculated from voltage and current values, and how this can be accomplished.

When increasing or decreasing the MCBC by calculating $P_{SA}$ for every n frames (n is an integer), if an image is displayed that turns ON and OFF in a cycle of n frame times, there arises the case where the MCBC is always controlled on the basis of $P_{SA}$ in the OFF state, causing the average power consumption to exceed its target value. To address this problem, n successive values of $P_{SA}$ are averaged, and the resulting average value $P_{AV}$ is used instead of $P_{SA}$.

Figure 16:
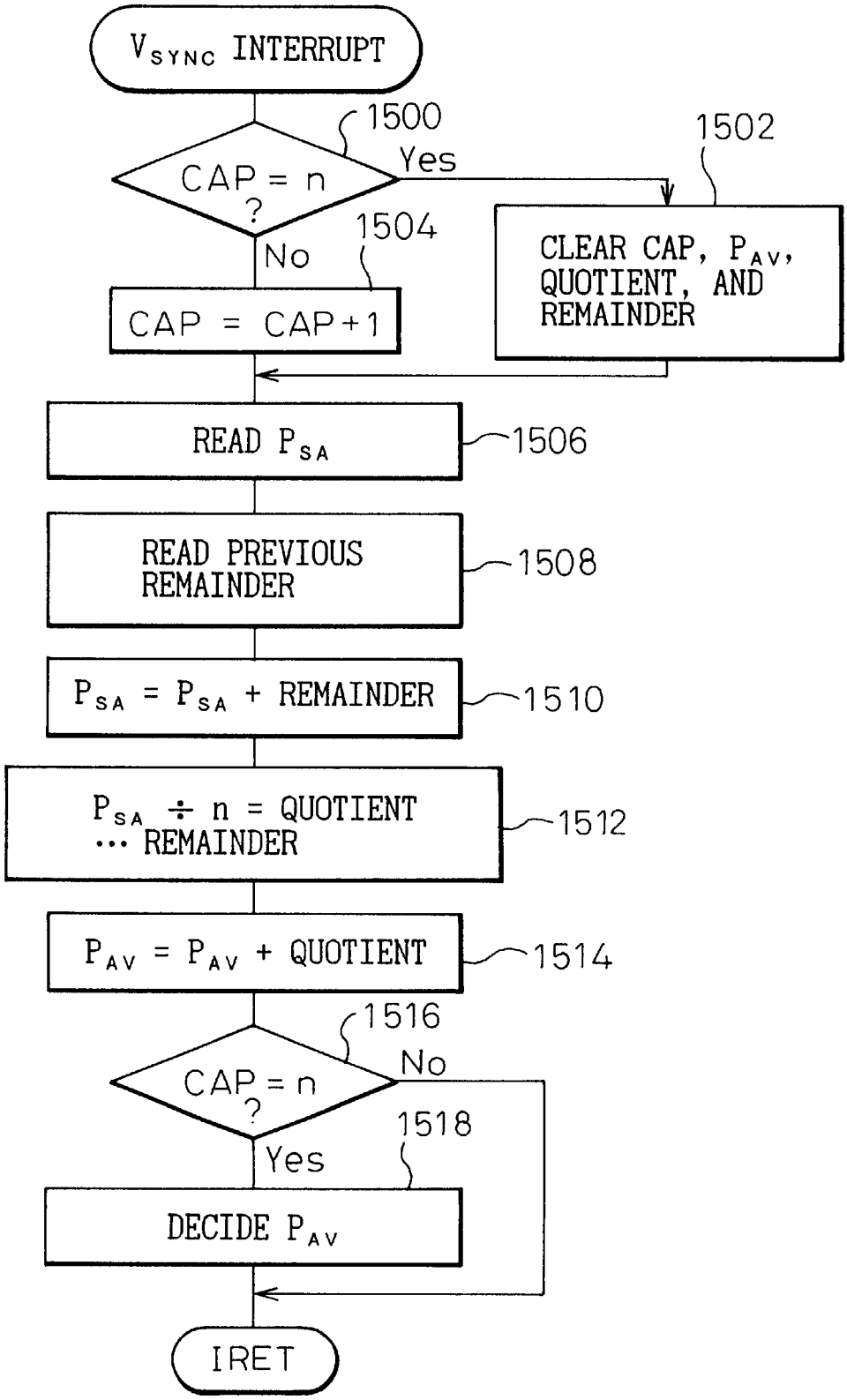
FIG. 16 is a flowchart showing a first means for implementing the averaging of power consumption.

FIG. 16 is a flowchart illustrating the processing for computing $P_{AV}$ by averaging $P_{SA}$, which is implemented by software of the MPU 64. In FIG. 16, when CAP has reached n, CAP, $P_{AV}$, the quotient, and the remainder are cleared (step 1502), and the process returns to the branch leading to step 1506. If CAP has not yet reached n, 1 is added to CAP (step 1504), $P_{SA}$ is read (step 1506), and the remainder from the previous processing is read (step 1508) and added to $P_{SA}$ (step 1510). $P_{SA}$ is divided by n to obtain the quotient and the remainder (step 1512), and the quotient is added to $P_{AV}$ (step 1514). If CAP is equal to n in step 1516, then $P_{AV}$ is determined (step 1518).

Figure 17:
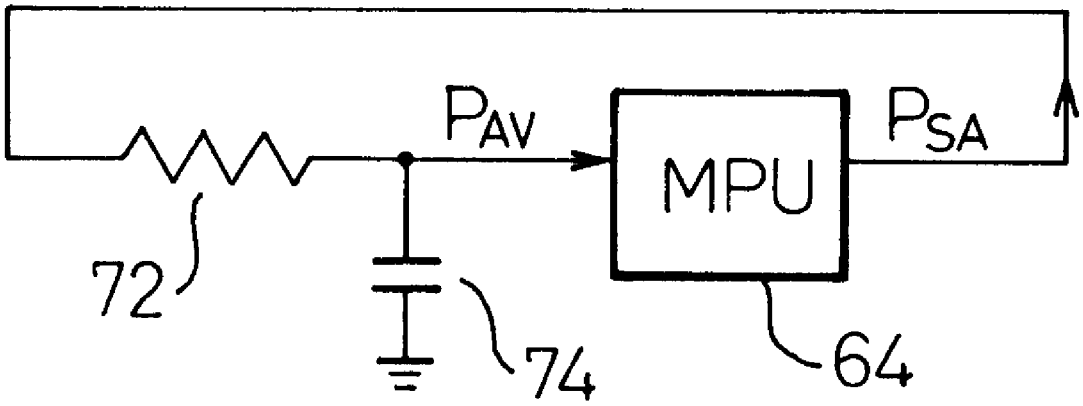
FIG. 17 is a circuit diagram showing a second means for implementing the averaging of power consumption.

FIG. 17 shows a configuration for implementing the averaging of $P_{SA}$ in hardware. In FIG. 17, the MPU 64 outputs $P_{SA}$ which is input to a delay circuit consisting of a resistor 72 and a capacitor 74. The MPU 64 then takes the output of this circuit as $P_{AV}$.

Figure 18:
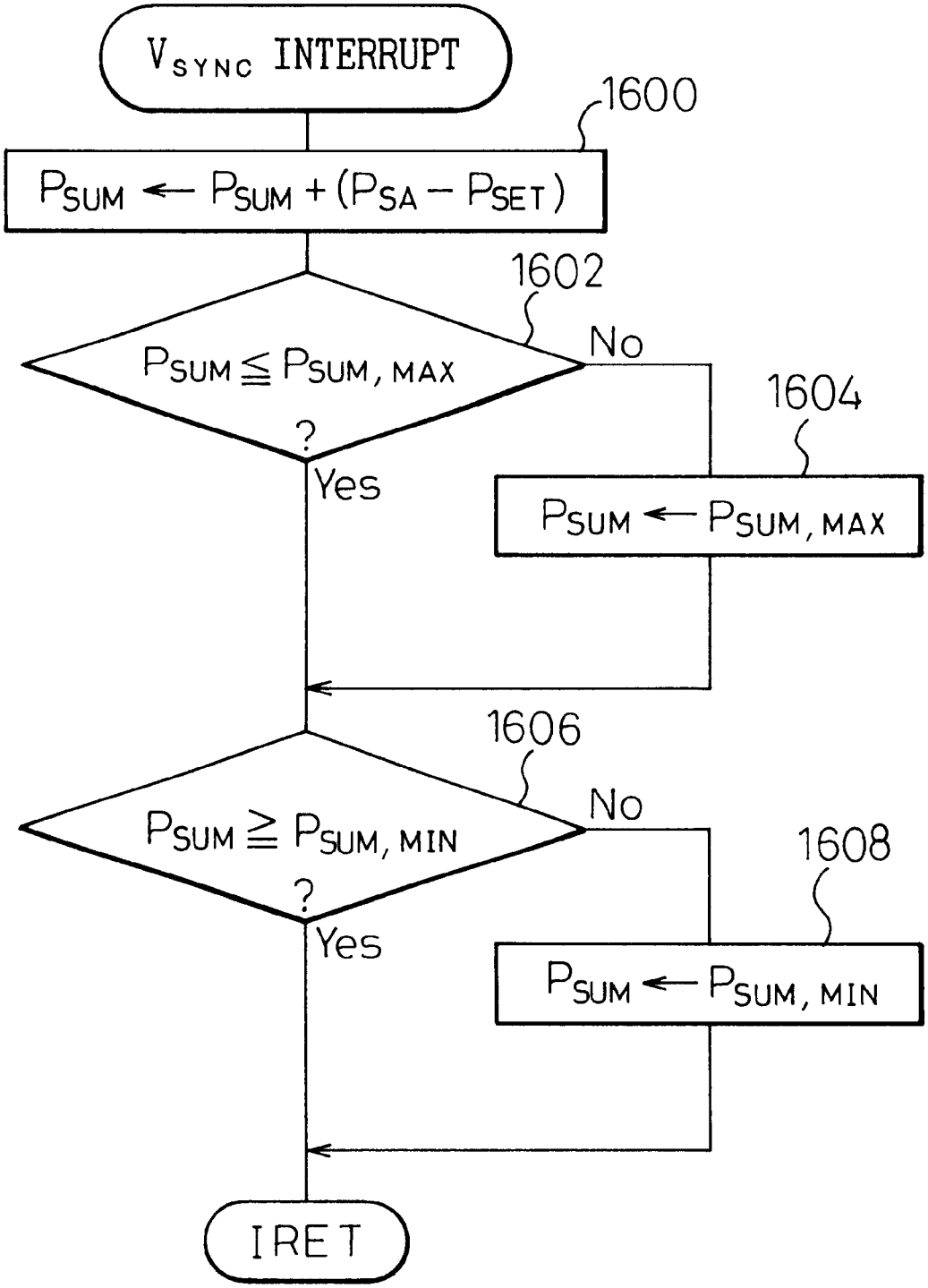
FIG. 18 is a flowchart illustrating a process for the calculation of power consumption sum value $P_{SUM}$according to a third embodiment of the present invention.
Figure 19:
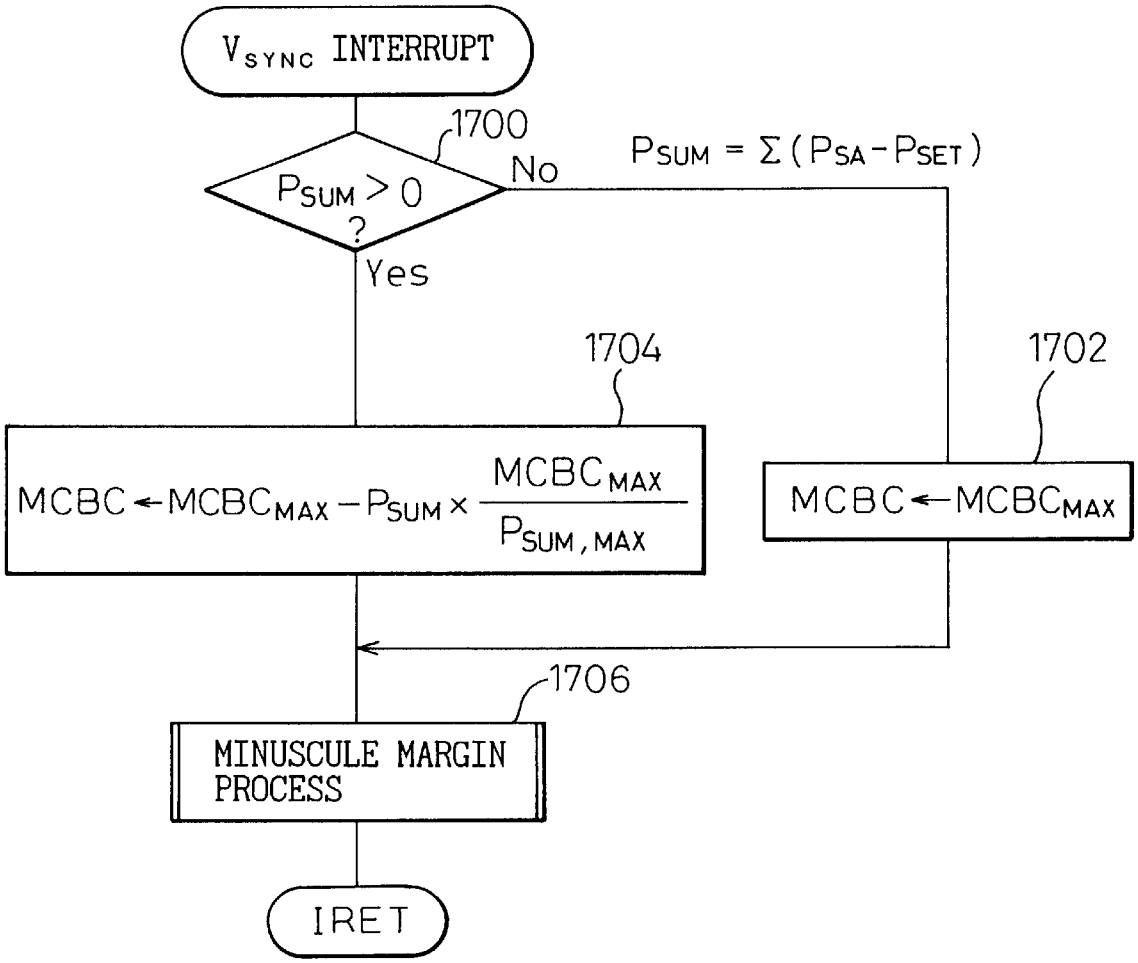
FIG. 19 is a flowchart illustrating a process for the calculation of MCBC according to the third embodiment; of the present invention.

FIGS. 18 and 19 illustrate the processing performed by the MPU in a power consumption control apparatus according to a third embodiment of the present invention. The hardware configuration of the third embodiment is the same as that of the first embodiment shown in FIG. 3.

The embodiments so far described have employed the technique in which the average power consumption is controlled to within the target value by increasing or decreasing the display brightness set value MCBC in accordance with an instantaneous value of power consumption and further by correcting the increasing or decreasing of MCBC or reducing pixel data in accordance with the sum value of the power consumption. In contrast, in the third embodiment of the present invention, the average power consumption is controlled to within the target value by determining the MCBC directly from the sum value of the power consumption.

FIG. 18 illustrates the processing performed by the MPU 64 for the calculation of the sum value $P_{SUM}$ according to the third embodiment of the present invention. In FIG. 18, the sum value $P_{sum}$ is calculated (step 1600) in the same manner as in step 1200 in FIG. 8, and if the sum value $P_{SUM}$ exceeds its maximum value $P_{SUM,MAX}$ (step 1602), $P_{SUM,MAX}$ is substituted for $P_{SUM}$. If the sum value $P_{SUM}$ is less than its minimum value $P_{SUM,MIN}$ (where $P_{SUM,MIN}<0$) (step 1606), $P_{SUM,MIN}$ is substituted for $P_{SUM}$.

FIG. 19 illustrates the process for determining the MCBC according to the third embodiment of the present invention. First, it is determined whether the sum value $P_{SUM}$ is positive or negative (step 1700). If $P_{SUM}$ is negative, the brightness set value MCBC is set to its maximum value $MCBC_{MAX}$ (step 1702). If $P_{SUM}$ is positive, the value calculated by the equation $$MCBC_{MAX}-P_{SUM}\times MCBC_{MAX}/P_{SUM,MAX}$$

is set as the MCBC (step 1704).

Figure 20:
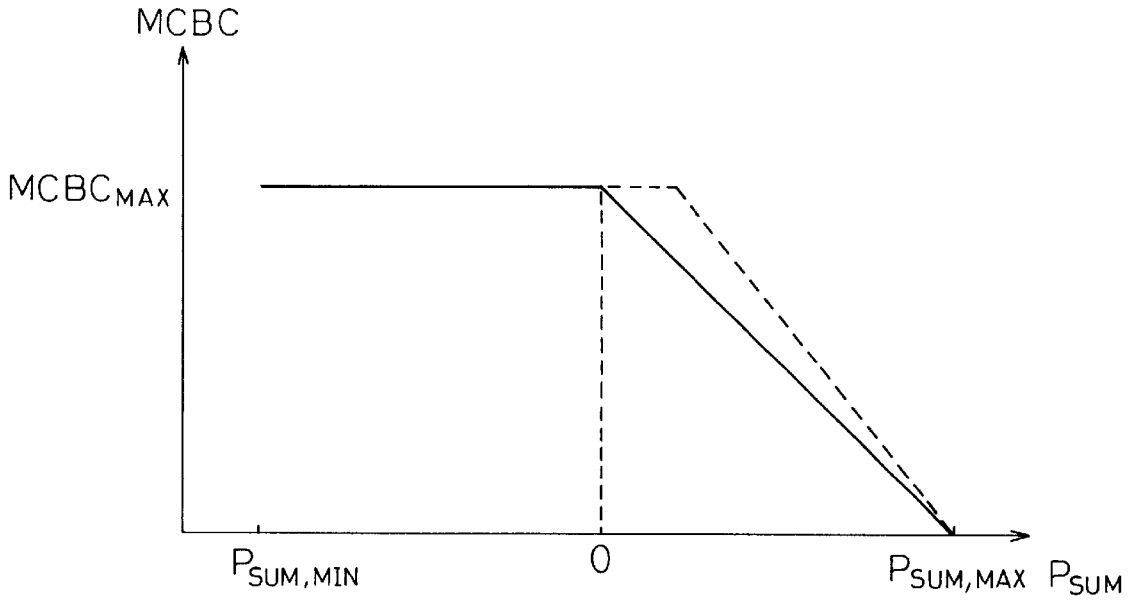
FIG. 20 is a graph illustrating a technique for calculating the value of MCBC from the value of $P_{SUM}$.

FIG. 20 shows the relationship between the sum value $P_{SUM}$ and the brightness set value MCBC determined in steps 1702 and 1704. As shown in FIG. 20, when the sum value $P_{SUM}$ is negative, MCBC is set to its maximum value $MCBC_{MAX}$, and when $P_{SUM}$ is positive, the value of MCBC linearly decreases with increasing $P_{SUM}$. Here, as shown by dashed line in FIG. 20, the threshold of $P_{SUM}$ at which the value of MCBC begins to decrease from its maximum value need not necessarily be set at 0.

Figure 21:
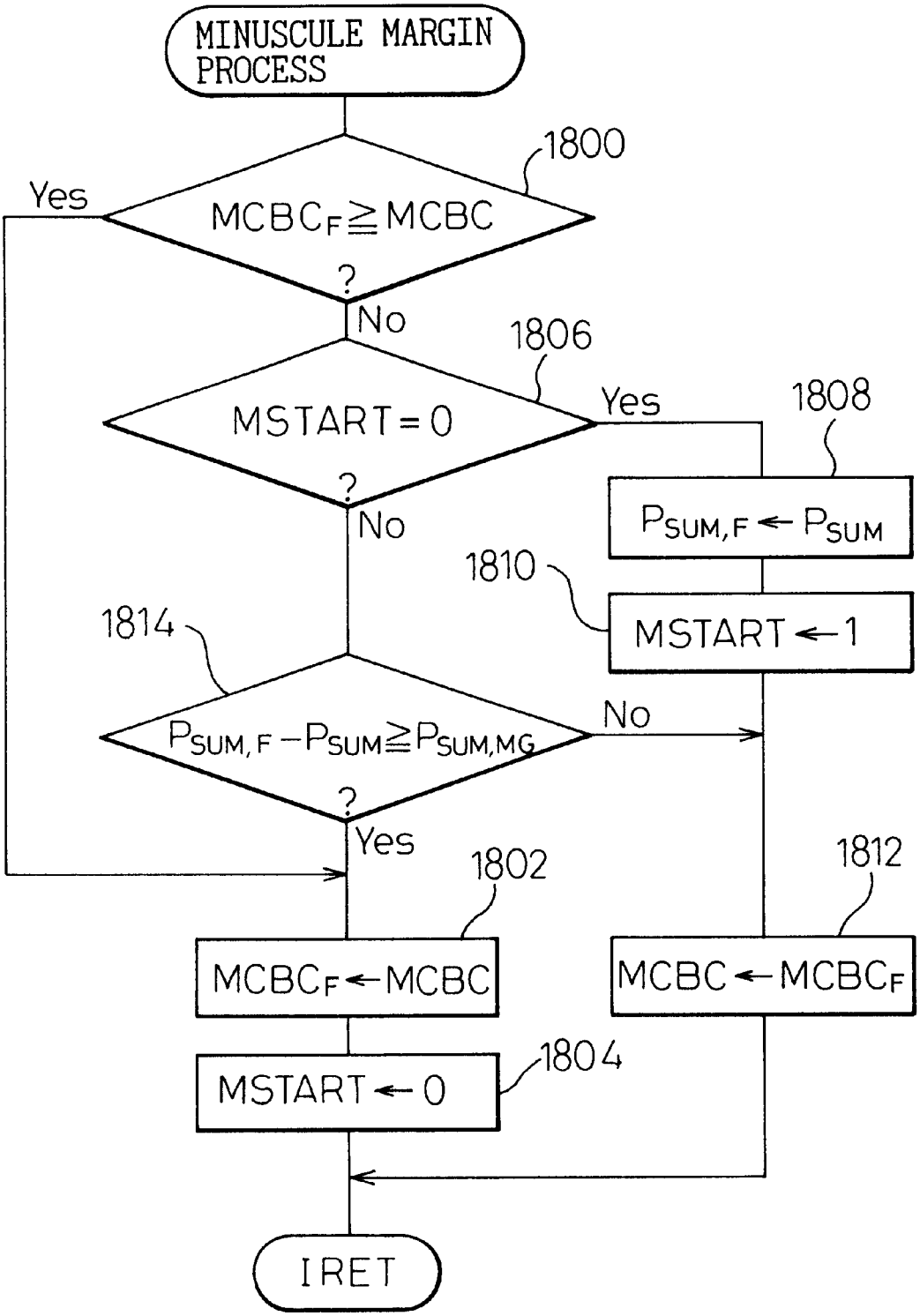
FIG. 21 is a flowchart illustrating a minuscule margin process.

In the third embodiment of the present invention, since the brightness set value MCBC is determined directly from the sum value $P_{SUM}$, if the values of $V_S$, $I_S$, $V_A$, and $I_A$ are near the A/D conversion threshold values of the A/D converters 50, 52, 60, and 62 (FIG. 3) a situation can occur where wandering of digital values is directly reflected in the value of MCBC, causing image flicker. To prevent this, a minuscule margin process is executed after the MCBC has been calculated from the sum value $P_{SUM}$. FIG. 21 shows the detail of the minuscule margin process executed in step 1706 in FIG. 19.

FIG. 21 concerns the case where the value of MCBC calculated from $P_{SUM}$ changes from decreasing to increasing. When the calculated MCBC is decreasing, since, in step 1800, MCBCP retaining the previous value of MCBC is larger than the current value of MCBC, the process proceeds to step 1802 where MCBC is substituted for $MCBC_F$, and after that, 0 is stored in flag MSTART. That is, when MCBC is decreasing, the calculated value of MCBC is directly used as the MCBC, and the flag MSTART is cleared to 0.

When the calculated value of MCBC changes from decreasing to increasing, since $MCBC_F<MCBC$ in step 1800, the process proceeds to step 1806 where it is determined whether the value of the flag MSTART is 0 or not. Since MSTART is 0 immediately after the change from decreasing to increasing, the process proceeds to step 1808 where the value of $P_{SUM}$ is substituted for $P_{SUM,F}$ retaining the current value of $P_{SUM}$; after that, the flag MSTART is set to 1 (step 1810), and $MCBC_F$, retaining the previous value of MCBC, is substituted for the MCBC (step 1812). That is, immediately after the value calculated from $P_{SUM}$ has changed from decreasing to increasing, the MCBC is not updated, and the current value of $P_{SUM}$ is stored as $P_{SUM,F}$, while setting the flag MSTART to 1.

When the calculated value continues to increase, since MSTART is 1, the process proceeds to step 1814 after steps 1800 and 1806. In step 1814, the value of $(P_{SUM,F}-P_{SUM})$ is compared with a predetermined margin $P_{SUM,MG}$. The value of $(P_{SUM,F}-P_{SUM})$ indicates how much the $P_{SUM}$ has decreased from the value of $P_{SUM}$ stored as $P_{SUM,F}$ when the calculated value of MCBC changed from decreasing to increasing (from FIG. 20, the increase in MCBC corresponds to the decrease in $P_{SUM}$) If the value of $(P_{SUM,F}-P_{SUM})$ is smaller than the margin $P_{SUM,MG}$, it is determined that the change is minuscule, and the process proceeds to step 1812 where the MCBC is not updated. If the value of $(P_{SUM,F}-P_{SUM})$ is equal to or larger than the margin $P_{SUM,MG}$, it is determined that the change is significant, and the process proceeds to step 1802 where the MCBC is updated.

With the above minuscule margin process, image flicker when the measured value is near the A/D conversion threshold value can be prevented.

Figure 22:
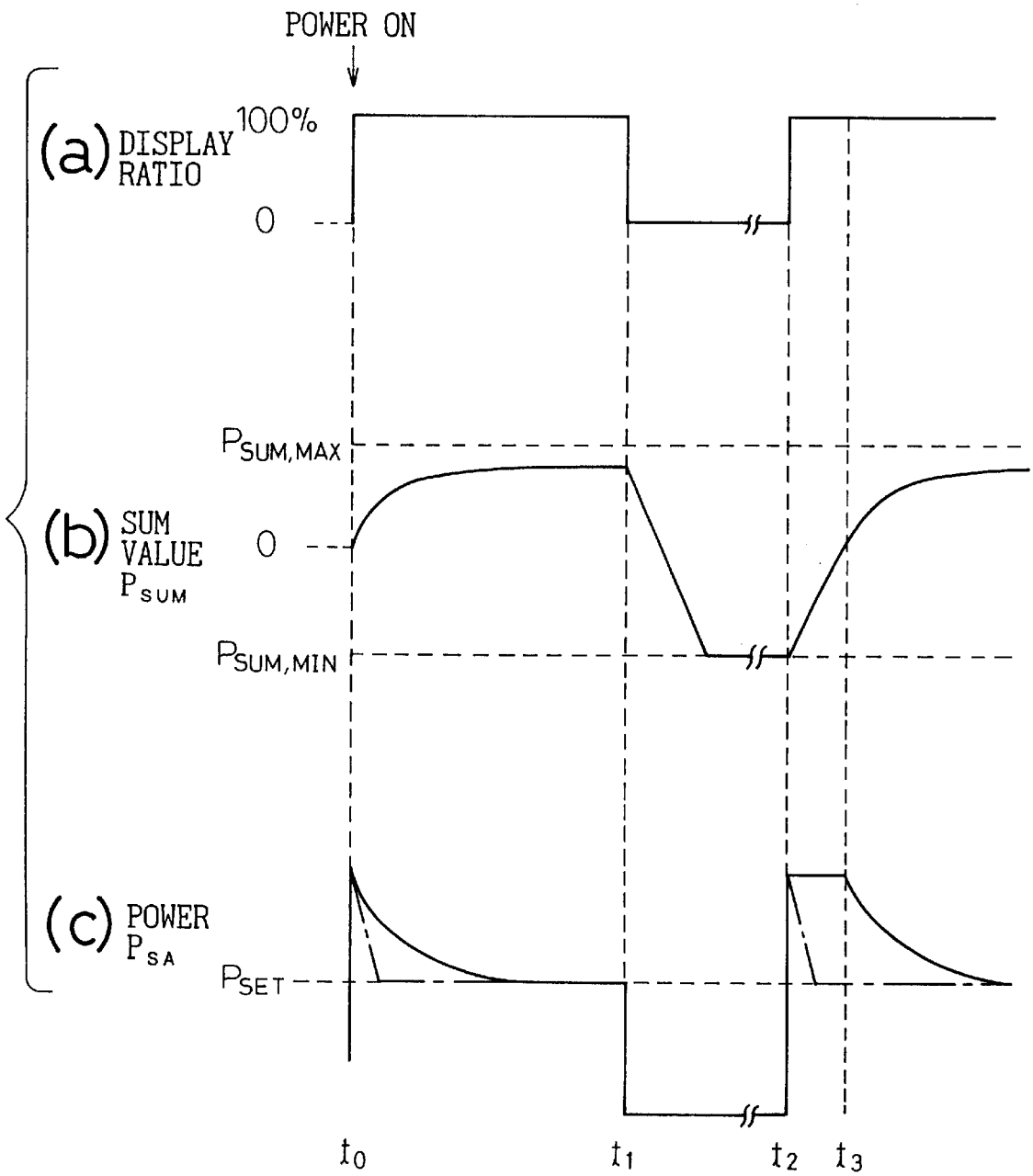
FIG. 22 is a graph showing a power consumption control operation according to the third embodiment of the present invention.

FIG. 22 shows the power consumption control operation according to the third embodiment of the present invention. It is assumed here that the display ratio (representing the percentage of ON pixels) immediately after power on at time $t_0$ is at 100% (ALL ON) as shown in part (a). At this time, the sum value $P_{SUM}$ increases from 0, as shown part (b), but since MCBC decreases with increasing $P_{SUM}$, instantaneous power consumption $P_{SA}$ decreases as shown in part (c), and accordingly the rising curve of the sum value $P_{SUM}$ gradually trails off. The falling curve of the instantaneous power $P_{SA}$ also gradually trails off until finally settling at the target power $P_{SET}$.

When the display is extinguished at time $t_1$ with the display ratio dropping to 0%, and the extinguished state continues for a sufficient period of time, the sum value $P_{SUM}$ drops to its minimum value $P_{SUM,MIN}$. When the display ratio becomes 100% at time $t_2$, the sum value $P_{SUM}$ begins to increase from $P_{SUM,MIN}$, but during the period when the sum value $P_{SUM}$ is negative, MCBC is maintained at its maximum value. As a result, as shown in part (c), the power consumption $P_{SA}$ during that period is maintained above the target value $P_{SET}$ to provide a screen brightness that matches the display ratio. In the meantime, the sum value $P_{SUM}$ increases linearly. When the sum value $P_{SUM}$ becomes positive, the instantaneous power $P_{SA}$ begins to decrease, its curve gradually sloping off and finally settling at $P_{SET}$, as already noted.

In this way, in the third embodiment of the present invention, the speed with which the brightness is reduced based on the power consumption control is fast when the screen is bright, and decreases gradually as the screen becomes dark, as shown in FIG. 22(*c*). Because of the characteristics of the human eye, when the screen is bright, the brightness change is not noticeable even if the brightness decreasing speed is fast, but when the screen is relatively dark, the brightness change becomes visible if the brightness decreasing speed is fast. Thus the above-described technique offers the advantage that the degradation in image quality due to power consumption control is not relatively noticeable, compared with the prior art technique in which the brightness is reduced at a constant speed when the instantaneous power has exceeded a target value (as shown by semi-dashed lines in FIG. 22(*c*)).

Figure 23:
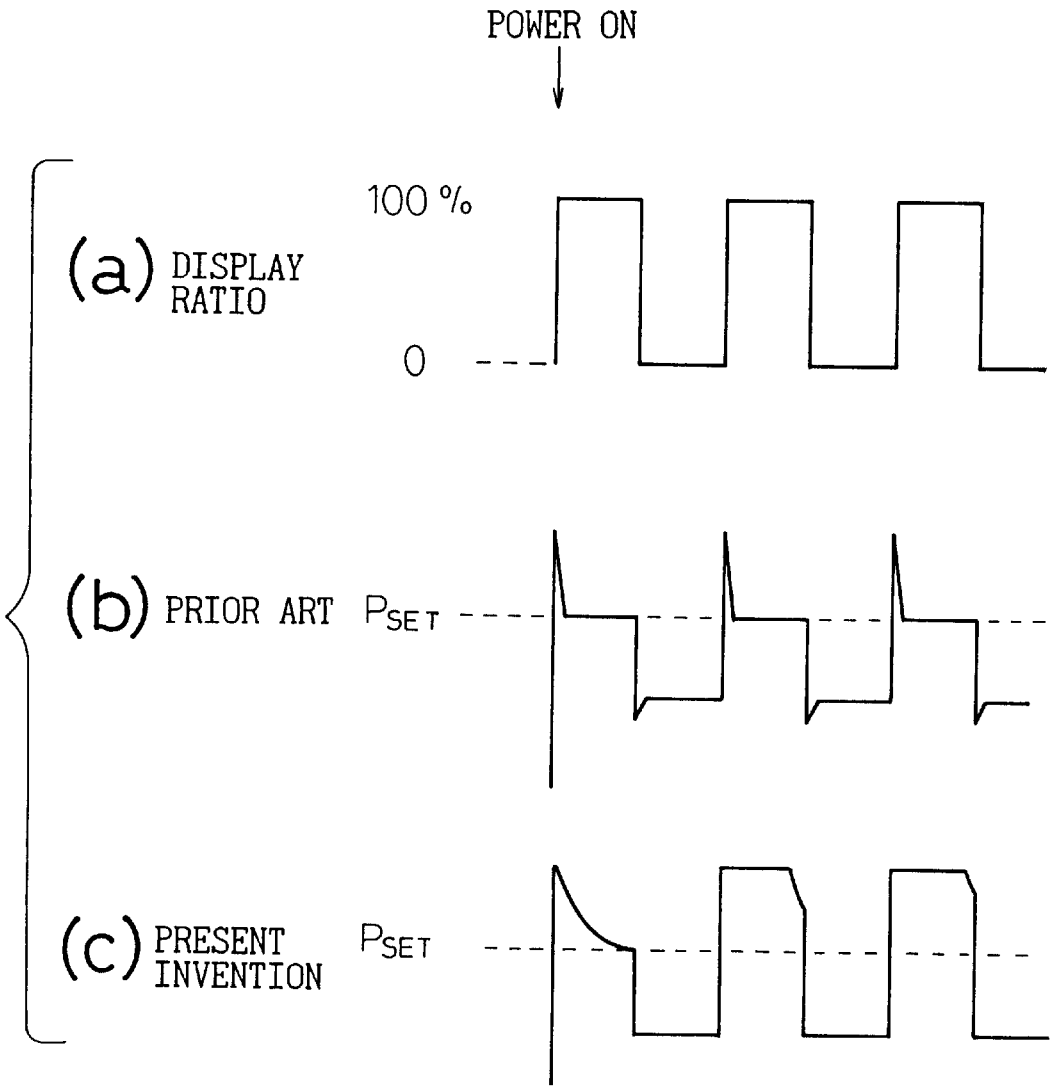
FIG. 23 is a graph showing the power consumption control operation according to the third embodiment of the present invention

Further, when the sum value of the power consumption is sufficiently low, as in the period from time $t_2$ to time $t_3$, sufficient brightness commensurate with the display ratio can be obtained. Accordingly, in the case of an image, such as a moving image, that entails rapid changes in display ratio, the degradation in image quality due to power consumption control is not noticeable. More specifically, when the display ratio changes as shown schematically in part (a) of FIG. 23, for example, in the prior art the brightness is controlled so that the instantaneous power is brought to its target value $P_{SET}$ when it increases above $P_{SET}$, as shown in part (b), while in the third embodiment of the present invention, the brightness that matches the change of the display ratio as close as possible can be achieved as shown in part (c).

The program implementing the processing flows of the MPU 64 thus far described is stored in a ROM (not shown) built into the MPU, but it is also possible to store the program in a separate storage medium such as a ROM and provide the program only.

As described above, according to the present invention, since the number of sustain pulses or the display data is controlled based on the sum value $P_{sum}$ that adds up excess power consumption values, the average value of power consumption does not exceed the set value regardless of the type of image pattern displayed, thus achieving optimum control of the number of sustain pulses or the display data considering picture quality.

What is claimed is:

1. A method of controlling power consumption of a display unit, comprising the steps of:

measuring the power consumption of the display unit;

increasing display brightness of the display unit at a first speed, or decreasing the display brightness at a second speed different from the first speed, in accordance with the measured value of the power consumption;

determining a sum value, based on the measured power consumption; and controlling the display brightness in accordance with the sum value, based on measured power consumption, and thereby controlling the power consumption to within a target value.

2. A method according to claim 1, wherein the display unit includes a plasma display panel and a plasma display panel control circuit capable of increasing or decreasing the brightness by increasing or decreasing the number of sustain pulses applied to the plasma display panel during one frame period.

3. A method according to claim 2, wherein the control circuit includes an input for setting the number of sustain pulses for the entire display as a display brightness value and an input for data of each pixel defining the number of sustain pulses for each pixel, and wherein the step of increasing or decreasing the brightness further comprises increasing or decreasing the display brightness value and thereby increasing or decreasing the display brightness, and the step of controlling the brightness further comprises correcting the increasing or decreasing of the display brightness value in accordance with the sum value, based on measured power consumption, and thereby controlling the display brightness.

4. A method according to claim 3, wherein:

the step of determining a sum value, based on the measured power consumption, further comprises summing differences between the measured power consumption and a target value thereof, and the step of correcting the increasing/decreasing of the brightness value further comprises:

storing the brightness value when the sum value of the differences is greater than a prescribed value and when the power consumption is substantially greater than the target value thereof; and setting the brightness value to a value determined based on the stored brightness value when the sum value of the differences is greater than the prescribed value and when the power consumption has increased from a level lower than the target value to a level substantially greater than the target value.

5. A method according to claim 3, wherein:

the step of determining a sum value, based on the measured power consumption, further comprises summing differences between the measured power consumption and the target value thereof, and the step of correcting the increasing/decreasing of the brightness value includes the step of fixing the brightness value to a designated value when the sum difference value is greater than a prescribed value.

6. A method according to claim 3, wherein:

the step of determining a sum value, based on the measured power consumption, further comprises summing differences between the measured power consumption and the target value thereof, and the step of correcting the increasing/decreasing of the brightness value changing the speed at which the brightness value is decreased in the step of increasing or decreasing the brightness value, in accordance with the sum difference value.

7. A method according to claim 3, wherein:

the step of summing the power consumption further comprises summing differences between the power consumption and its target value, and the step of correcting the increasing/decreasing of the brightness value further comprises changing the respective speeds at which the brightness value is increased or decreased in respectively increasing or decreasing the brightness value, in accordance with the corresponding sum difference value.

8. A method according to claim 2, wherein the control circuit includes an input for setting the number of sustain pulses for the entire display as a display brightness value, and an input for data of each pixel defining the number of sustain pulses for each pixel, the step of increasing or decreasing the brightness further comprises increasing or decreasing the display brightness value and thereby increasing or decreasing the display brightness, and the step of controlling the brightness further comprises determining a subtrahend based on the sum value of the power consumption and subtracting the subtrahend from data of all pixels thereby controlling the display brightness.

9. A method according to claim 8, wherein:

the step of summing the power consumption further comprises summing differences between the power consumption and its target value, and the step of determining the subtrahend further comprises determining the subtrahend based on the sum difference value.

10. A method according to claim 2, wherein the display unit further includes a first driver for driving address electrodes of the plasma display panel and a second driver for driving scan electrodes and common electrodes of the plasma display panel, and the step of measuring the power consumption further comprises:

measuring power consumed in the first driver;

measuring power consumed in the second driver; and computing the power consumption of the display unit by adding the power consumption of the first driver to the power consumption of the second driver.

11. A method according to claim 1, wherein:

when the step of increasing or decreasing the brightness is carried out for every n frames, where n is an integer, and further comprises:

averaging the power consumption over n successive frames; and increasing or decreasing the brightness in accordance with the averaged power consumption.

12. An apparatus for controlling power consumption of a display unit, comprising:

means for inputting a measured value of the power consumption of the display unit;

means for increasing display brightness of the display unit at a first speed, or decreasing the display brightness at a second speed different from the first speed, in accordance with the measured value of the power consumption;

means for determining a sum value, based on the measured power consumption; and means for controlling the display brightness in accordance with the sum value, based on the measured power consumption and thereby controlling the power consumption to within a target value.

13. An apparatus according to claim 12, wherein the display unit includes a plasma display panel and a plasma display panel control circuit capable of increasing or decreasing the brightness by increasing or decreasing the number of sustain pulses applied to the plasma display panel during one frame period.

14. An apparatus according to claim 13, wherein:

the control circuit includes an input for setting the number of sustain pulses for the entire display as a display brightness value, and an input for data of each pixel defining the number of sustain pulses for each pixel, the means for increasing or decreasing the brightness further comprises means for increasing or decreasing the display brightness value and thereby increasing or decreasing the display brightness, and the means for controlling the brightness further comprises means for correcting the increasing or decreasing of the display brightness value in accordance with the sum value, based on the measured power consumption, and thereby controlling the display brightness.

15. An apparatus according to claim 14, wherein:

the means for determining a sum value based on the measured power consumption, further comprises means for summing differences between the measured power consumption and its target value, and the means for correcting the increasing/decreasing of the brightness value further comprises:

means for storing the brightness value when the sum value of the differences is greater than a prescribed value and when the measured power consumption is substantially greater than the target value; and means for setting the brightness value to a value determined based on the stored brightness value when the sum value of the differences is greater than the prescribed value and when the measured power consumption has increased from a level lower than the target value to a level substantially greater than the target value.

16. An apparatus according to claim 14, wherein:

the means for determining a sum value, based on the measured power consumption, further comprises means for summing differences between the measured power consumption and the target value thereof, and the means for correcting the increasing/decreasing of the brightness value includes means for fixing the brightness value to a designated value when the sum value of the differences is greater than a prescribed value.

17. An apparatus according to claim 14, wherein:

the means for determining a sum value, based on the measured power consumption, further comprises means for summing differences between the measured power consumption and the target value thereof, and the means for correcting the increasing/decreasing of the brightness value includes means for changing the speed at which the brightness value is decreased by the means for increasing or decreasing the brightness value, in accordance with the sum value of the differences.

18. An apparatus according to claim 14, wherein:

the means for determining a sum value, based on the measured power consumption includes means for summing differences between the measured power consumption and the target value thereof, and the means for correcting the increasing/decreasing of the brightness value includes means for changing the speed at which the brightness value is increased by the means for increasing or decreasing the brightness value, in accordance with the sum value of the differences.

19. An apparatus according to claim 13, wherein:

the control circuit further comprises an input for setting the number of sustain pulses for the entire display as a display brightness value, and an input for data of each pixel defining the number of sustain pulses for each pixel, the means for increasing or decreasing the brightness further comprises means for increasing or decreasing the display brightness value and thereby increasing or decreasing the display brightness, and the means for controlling the brightness further comprises means for determining a subtrahend based on the sum value, based on the measured power consumption, and means for subtracting the subtrahend from data of all pixels and thereby controlling the display brightness.

20. An apparatus according to claim 19, wherein:

the means for determining a sum value, based on the measured power consumption, includes means for summing differences between the measured power consumption and the target value thereof, and the means for determining the subtrahend further comprises means for determining the subtrahend based on the sum difference value.

21. An apparatus according to claim 13, wherein:

the display unit further comprises a first driver for driving address electrodes of the plasma display panel and a second driver for driving scan electrodes and common electrodes of the plasma display panel; and the means for measuring the power consumption further comprises:

means for measuring power consumed in the first driver;

means for measuring power consumed in the second driver; and means for computing the power consumption of the display unit by adding the power consumption of the first driver to the power consumption of the second driver.

22. An apparatus according to claim 12, wherein when the means for increasing or decreasing the brightness is activated every n frames, where n is an integer, the means for increasing or decreasing the brightness further comprises:

means for averaging the power consumption over n successive frames; and means for increasing or decreasing the brightness in accordance with the averaged power consumption.

23. A method of controlling power consumption of a display unit, comprising the steps of:

measuring the power consumption of the display unit;

summing differences between the power consumption and a target value of power consumption and producing a sum difference value;

determining a display brightness value for the display unit from the sum difference value; and setting the determined display brightness value in the display unit.

24. A method according to claim 23 wherein, in the step of determining the brightness value, the brightness value:

is held constant when the sum difference value of the power consumption is less than a prescribed threshold value, and decreases monotonically with an increasing sum value when the sum difference value is greater than the prescribed threshold value.

25. A method according to claim 24, wherein, in the step of determining the brightness value, when the sum difference value of the power consumption is greater than the prescribed threshold value, the brightness value decreases linearly with increasing sum value.

26. A method according to claim 24, wherein, in the step of summing, when the sum value is less than a prescribed lower limit value, the sum difference value is set at the lower limit value.

27. A method according to claim 24, wherein in the step of determining the brightness value, when the value determined from the sum difference value is increasing or decreasing, if an amount of increase or decrease of the sum value is smaller than a prescribed margin when compared with the sum difference value determined at the beginning of the increase or decrease, the brightness value is not updated but is held at the previously determined value.

28. An apparatus for controlling power consumption of a display unit, comprising:

means for inputting a measured value of the power consumption of the display unit;

means for summing differences between the power consumption and a target value thereof;

means for determining a display brightness value for the display unit from the sum difference value; and means for setting the determined display brightness value in the display unit.

29. An apparatus according to claim 28, wherein the brightness value determining means determines the brightness value, such that the brightness value:

is held constant when the sum difference value of the power consumption is less than a prescribed threshold value, and decreases monotonically with an increasing sum value when the sum difference value is greater than the prescribed threshold value.

30. An apparatus according to claim 29, wherein the brightness value determining means determines the brightness value, such that when the sum difference value of the power consumption is greater than the prescribed threshold value, the brightness value decreases linearly with an increasing sum difference value.

31. An apparatus according to claim 29, wherein the summing means, when the sum difference value is less than a prescribed lower limit value, sets the sum difference value at the lower limit value.

32. An apparatus according to claim 29, wherein the brightness value determining means determines the brightness value such that when the value determined from the sum difference value is increasing or decreasing, if an amount of increase or decrease of the sum difference value is smaller than a prescribed margin when compared with the sum difference value determined at the beginning of the increase or decrease, the brightness value is not updated but held at the previously determined value.

33. A display system comprising:

an apparatus for controlling power consumption of a display unit, including means for inputting a measured value of the power consumption of the display unit, means for increasing display brightness of the display unit at a first speed, or decreasing the display brightness at a second speed different from the first speed, in accordance with the measured value of the power consumption, means for determining a sum value, based on the measured power consumption, and means for controlling the display brightness in accordance with the sum value, based on the measured power consumption and thereby controlling the power consumption to within a target value;

a plasma display panel;

a drive circuit for driving the plasma display panel; and the control circuit controlling the drive circuit in accordance with a set value supplied from the power consumption control apparatus.

34. A system according to claim 33, wherein the display unit includes a plasma display panel and a plasma display panel control circuit selectively increasing or decreasing the brightness by increasing or decreasing the number of sustain pulses applied to the plasma display panel during one frame period.

35. A system according to claim 34, wherein:

the control circuit includes an input for setting the number of sustain pulses for the entire display as a display brightness value, and an input for data of each pixel defining the number of sustain pulses for each pixel, the means for increasing or decreasing the brightness includes means for increasing or decreasing the display brightness value and thereby increasing or decreasing the display brightness, and the means for controlling the brightness includes means for correcting the increasing or decreasing of the display brightness value in accordance with the sum value, based on the measured power consumption and thereby controlling the display brightness.

36. A system according to claim 35, wherein:

the means for determining a sum value, based on the measured power consumption further comprises means for summing differences between the power consumption and its target value and outputting a sum difference value, and the means for correcting the increasing/decreasing of the brightness value further comprises:

means for storing the brightness value when the sum difference value is greater than a prescribed value and when the power consumption is substantially greater than the target value thereof; and means for setting the brightness value to a value determined based on the stored brightness value, when the sum difference value is greater than the prescribed value and when the power consumption has increased from a level lower than the target value thereof to a level substantially greater than the target value thereof.

37. A system according to claim 35, wherein:

the means for determining a sum value, based on the measured power consumption, further comprises means for summing differences between the power consumption and its target value, and the means for correcting the increasing/decreasing of the brightness value further comprises means for fixing the brightness value to a designated value when the sum difference value is greater than a prescribed value.

38. A system according to claim 35, wherein the means for determining a sum value based on the measured power consumption, includes means for summing differences between the power consumption and the target value thereof, and the means for correcting the increasing/decreasing of the brightness value includes means for changing the speed at which the brightness value is decreased by the means for increasing or decreasing the brightness value, in accordance with the sum difference value.

39. A system according to claim 35, wherein:

the means for determining a sum value, based on the measured power consumption, further comprises means for summing differences between the measured power consumption and a target value thereof, and the means for correcting the increasing/decreasing of the brightness value further comprises means for changing the speed at which the brightness value is increased by the means for increasing or decreasing the brightness value, in accordance with the sum difference value.

40. A system according to claim 34, wherein:

the control circuit further comprises an input for setting the number of sustain pulses for the entire display as a display brightness value, and an input for data of each pixel defining the number of sustain pulses for each pixel;

the means for increasing or decreasing the brightness further comprises means for increasing or decreasing the display brightness value and thereby increasing or decreasing the display brightness, and the means for controlling the brightness further comprises means for determining a subtrahend based on the sum difference value, and means for subtracting the subtrahend from data of all pixels and thereby controlling the display brightness.

41. A system according to claim 40, wherein:

the means for summing the power consumption further comprises means for summing differences between the power consumption and its target value, and the means for determining the subtrahend further comprises means for determining the subtrahend based on the sum difference value.

42. A system according to claim 34, wherein:

the display unit further comprises a first driver for driving address electrodes of the plasma display panel and a second driver for driving scan electrodes and common electrodes of the plasma display panel, and the means for measuring the power consumption further comprises:

means for measuring power consumed in the first driver;

means for measuring power consumed in the second driver, and means for computing the power consumption of the display unit by adding the power consumption of the first driver to the power consumption of the second driver.

43. A system according to claim 33, wherein when the means for increasing or decreasing the brightness is activated for every n frames, where n is an integer, the means for increasing or decreasing the brightness further comprises:

means for averaging the power consumption over n successive frames; and means for increasing or decreasing the brightness in accordance with the averaged power consumption.

44. A display system comprising:

an apparatus controlling power consumption of a display unit, further comprises means for inputting a measured value of the power consumption of the display unit, means for summing differences between the power consumption and its target value and producing a sum difference value, means for determining a display brightness value for the display unit from the sum difference value of the power consumption, and means for setting the determined display brightness value in the display unit;

a plasma display panel;

a drive circuit for driving the plasma display panel; and a control apparatus for controlling the drive circuit in accordance with a set value supplied from the power consumption control apparatus.

45. A system according to claim 44, wherein the brightness value determining means determines the brightness value such that the brightness value is held constants when the sum difference value is less than a prescribed threshold value, and decreases monotonically with increasing sum value, when the sum difference value is greater than the prescribed threshold value.

46. A system according to claim 45, wherein the brightness value determining means determines the brightness value such that when the sum difference value of the power consumption is greater than the prescribed threshold value, the brightness value decreases linearly with increasing sum difference value.

47. A system according to claim 45, wherein the summing means, when the sum difference value is less than a prescribed lower limit value, sets the sum difference value at the lower limit value.

48. A system according to claim 45, wherein the brightness value determining means determines the brightness value such that when the value determined from the sum difference value is increasing or decreasing, if an amount of increase or decrease of the sum difference value is smaller than a prescribed margin when compared with the sum difference value determined at the beginning of the increase or decrease, the brightness value is not updated but is held at the previously determined value.

49. A storage medium readable by a machine, tangibly embodying a program of instructions executable by the machine to perform method steps for controlling power consumption of a display unit, said method steps comprising:

measuring the power consumption of the display unit;

increasing display brightness of the display unit at a first speed, or decreasing the display brightness at a second speed different from the first speed, in accordance with the measured value of the power consumption;

determining a sum value, based on the measured power consumption; and controlling the display brightness in accordance with the sum value, based on the measured power consumption, and thereby controlling the power consumption to within a target value thereof.

50. A storage medium according to claim 49, wherein the display unit includes a plasma display panel and a plasma display panel control circuit capable of increasing or decreasing the brightness by increasing or decreasing the number of sustain pulses applied to the plasma display panel during one frame period.

51. A storage medium according to claim 50, wherein the control circuit further comprises an input for setting the number of sustain pulses for the entire display as a display brightness value, and an input for data of each pixel defining the number of sustain pulses for each pixel, and wherein:

the step of increasing or decreasing the brightness further comprises increasing or decreasing the display brightness value and thereby increasing or decreasing the display brightness, and the step of controlling the brightness further comprises correcting the increasing or decreasing of the display brightness value in accordance with the sum difference value and thereby controlling the display brightness.

52. A storage medium according to claim 51, wherein:

the step of determining a sum value, based on the measured power consumption, further comprises summing differences between the measured power consumption and a target value thereof, and the step of correcting the increasing/decreasing of the brightness value comprises:

storing the brightness value when the sum difference value is greater than a prescribed value and when the power consumption is substantially greater than the target value thereof; and setting the brightness value to a value determined based on the stored brightness value when the sum difference value is greater than the prescribed value and when the power consumption has increased from a level lower than the target value to a level substantially greater than the target value.

53. A storage medium according to claim 51, wherein:

the step of determining a sum value, based on the measured power consumption, further comprises summing differences between the measured power consumption and the target value thereof, and the step of correcting the increasing/decreasing of the brightness value includes the step of fixing the brightness value to a designated value when the sum difference value is greater than a prescribed value.

54. A storage medium according to claim 51, wherein:

the step of determining a sum value, based on the measured power consumption, further comprises summing differences between the measured power consumption and its target value, and the step of correcting the increasing/decreasing of the brightness value further comprises changing the speed at which the brightness value is decreased in the step of increasing or decreasing the brightness value, in accordance with the sum difference value.

55. A storage medium according to claim 51, wherein:

the step of summing the power consumption further comprises summing differences between the power consumption and its target value, and the step of correcting the increasing/decreasing of the brightness value further comprises changing the respective speeds at which the brightness value is increased or decreased in increasing or decreasing the brightness value, in accordance with the corresponding sum difference value.

56. A storage medium according to claim 50, wherein the control circuit includes an input for setting the number of sustain pulses for the entire display as a display brightness value, and an input for data of each pixel defining the number of sustain pulses for each pixel, and wherein the step of increasing or decreasing the brightness further comprises increasing or decreasing the display brightness value and thereby increasing or decreasing the display brightness, and the step of controlling the brightness further comprises determining a subtrahend based on the sum value of the power consumption and subtracting the subtrahend from data of all pixels thereby controlling the display brightness.

57. A storage medium according to claim 56, wherein:

the step of summing the power consumption further comprises summing differences between the power consumption and its target value, and the step of determining the subtrahend further comprises determining the subtrahend based on the sum difference value.

58. A storage medium according to claim 50, wherein the display unit further includes a first driver for driving address electrodes of the plasma display panel and a second driver for driving scan electrodes and common electrodes of the plasma display panel, and wherein the step of measuring the power consumption further comprises:

measuring power consumed in the first driver;

measuring power consumed in the second driver; and computing the power consumption of the display unit by adding the power consumption of the first driver to the power consumption of the second driver.

59. A storage medium according to claim 49, wherein:

when the step of increasing or decreasing the brightness is carried out for every n frames, where n is an integer, further comprises:

averaging the power consumption over n successive frames; and increasing or decreasing the brightness in accordance with the averaged power consumption.

60. A storage medium readable by a machine, tangibly embodying a program of instructions executable by the machine to perform method steps for controlling power consumption of a display unit, said method steps comprising:

measuring the power consumption of the display unit;

summing differences between the power consumption and a target value thereof;

determining a display brightness value for the display unit from the sum difference value; and setting the determined display brightness value in the display unit.

61. A storage medium according to claim 60, wherein, in the step of determining the brightness value, the brightness value is determined such that the brightness value:

is held constant when the sum difference value of the power consumption is less than a prescribed threshold value, and decreases monotonically with an increasing sum value when the sum difference value is greater than the prescribed threshold value.

62. A storage medium according to claim 61, wherein in the step of determining the brightness value, the brightness value is determined such that when the sum difference value of the power consumption is greater than the prescribed threshold value, the brightness value decreases linearly with increasing sum difference value.

63. A storage medium according to claim 61, wherein, in the step of summing, when the sum difference value is less than a prescribed lower limit value, the sum difference value is set at the lower limit value.

64. A storage medium according to claim 61, wherein, in the step of determining the brightness value, when the value determined from the sum difference value is increasing or decreasing, if an amount of increase or decrease of the sum value is smaller than a prescribed margin when compared with the sum difference value determined at the beginning of the increase or decrease, the brightness value is not updated but held at the previously determined value.

* * * * *